US010149559B2

(12) United States Patent
Marks

(10) Patent No.: US 10,149,559 B2
(45) **Date of Patent: *Dec. 11, 2018**

(54) DEVICE FOR HANGING OBJECTS

(71) Applicant: CRESCENT CREATIVE PRODUCTS, LLC, Wheeling, IL (US)

(72) Inventor: Michael A. Marks, Naperville, IL (US)

(73) Assignee: Crescent Creative Products, LLC, Wheeling, IL (US)

( * ) Notice: Subject to any disclaimer, the term of this patent is extended or adjusted under 35 U.S.C. 154(b) by 468 days.

This patent is subject to a terminal disclaimer.

(21) Appl. No.: 14/996,477

(22) Filed: Jan. 15, 2016

(65) Prior Publication Data

US 2016/0128497 A1 May 12, 2016

Related U.S. Application Data

(63) Continuation of application No. 14/045,390, filed on Oct. 3, 2013, now Pat. No. 9,237,819.

(60) Provisional application No. 61/712,605, filed on Oct. 11, 2012.

(51) Int. Cl.

| | |
|---|---|
| ***A47G 1/16*** | (2006.01) |
| ***A47G 1/24*** | (2006.01) |
| ***A47G 1/20*** | (2006.01) |

(52) U.S. Cl.

CPC ..... *A47G 1/24* (2013.01); *A47G 1/205* (2013.01)

(58) Field of Classification Search

CPC . A47G 1/205; A47G 1/16; B25H 7/00; B25H 7/04; G01B 3/04

USPC ..... 248/323, 327, 476, 495; 33/418, 419, 33/427, 451, 464, 478, 526, 561.1, 613, 33/666

See application file for complete search history.

(56) References Cited

U.S. PATENT DOCUMENTS

| | | | | |
|---|---|---|---|---|
| 1,192,418 | A * | 7/1916 | Hallberg | E04F 21/003 33/194 |
| D136,978 | S | 1/1944 | Tomasini | |
| 4,882,846 | A | 11/1989 | Reed | |
| 5,342,014 | A | 8/1994 | Wilson | |
| 5,451,027 | A | 9/1995 | McHenry | |
| 5,491,905 | A | 2/1996 | Jablonski | |
| 5,634,279 | A | 6/1997 | Ariyo | |
| 6,029,362 | A | 2/2000 | Miodragovic | |
| 6,134,797 | A | 10/2000 | Boyce | |

(Continued)

FOREIGN PATENT DOCUMENTS

| | | | |
|---|---|---|---|
| DE | 202011005645 U1 * | 7/2011 | B26B 29/06 |
| GB | 2185115 | 7/1987 | |

*Primary Examiner* — R. A. Smith

(74) *Attorney, Agent, or Firm* — Foley & Lardner LLP

(57) ABSTRACT

A device for hanging an object on a wall includes a crossbar, a knuckle, an arm, and an end cap. The crossbar includes a track extending between two opposing ends of the crossbar. The knuckle is slidably coupled to the crossbar such that the knuckle is slidable in a first direction. The knuckle includes a projection that has a pair of parallel sides. The arm has a marking pin that projects generally perpendicular from a forward surface of the arm. The arm is coupled to the crossbar via the knuckle such that the arm is slidable along the pair of parallel sides of the projection in a second direction. The end cap is coupled to one of the two opposing ends of the crossbar. The end cap includes an "L" bracket that provides an engagement surface for engaging a corner of a second object previously hung on the wall.

7 Claims, 25 Drawing Sheets

(56) References Cited

U.S. PATENT DOCUMENTS

| | | | | |
|---|---|---|---|---|
| 6,260,283 | B1 | 7/2001 | Abernathy | |
| 6,836,969 | B1 | 1/2005 | Bates | |
| 6,883,244 | B2 | 4/2005 | Rimback | |
| 6,952,887 | B2 | 10/2005 | Muchnik | |
| 6,978,551 | B2 | 12/2005 | Krake | |
| 6,988,324 | B2 | 1/2006 | Vicario | |
| 7,082,692 | B2 | 8/2006 | Shapiro | |
| 7,155,840 | B1 | 1/2007 | Carbonaro | |
| 7,159,328 | B1 | 1/2007 | Duda | |
| 7,503,126 | B2 | 3/2009 | Robins | |
| 7,814,675 | B2 | 10/2010 | Venderley | |
| 8,261,462 | B2 | 9/2012 | Coyle | |
| 8,864,095 | B1 | 10/2014 | Marks | |
| 9,038,982 | B1 | 5/2015 | Marks | |
| 9,182,209 | B1 * | 11/2015 | Johnson | G01B 3/20 |
| 9,237,819 | B1 * | 1/2016 | Marks | A47G 1/205 |
| 2002/0189119 | A1 | 12/2002 | High | |
| 2004/0060183 | A1 | 4/2004 | Moas | |

* cited by examiner

DEVICE FOR HANGING OBJECTS

CROSS-REFERENCE TO RELATED APPLICATIONS

This application is a continuation of U.S. application Ser. No. 14/045,390, filed Oct. 3, 2013, now allowed, which claims the benefit of U.S. Provisional Application No. 61/712,605, filed Oct. 11, 2012, each of which is hereby incorporated by reference herein in its entirety. This application is related to U.S. patent application Ser. No. 13/309,743, filed Dec. 2, 2011, now U.S. Pat. No. 9,038,982, which claims the benefit of U.S. Provisional Application No. 61/420,010, filed Dec. 6, 2010, each of which is hereby incorporated by reference herein in its entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present disclosure relates generally to devices for hanging objects and, more particularly, to devices for horizontally mounting framed objects having hooks on a rear surface thereof.

BACKGROUND

Walls of a room are typically decorated by retaining and/or hanging objects thereon. The objects can be in the form of photographs, paintings, mirrors, and the like, which are generally rectangular in shape. In decorating the wall, it is desirable that the objects are positioned on the wall in an aesthetically pleasing manner. To be aesthetically pleasing, it is desirable that objects having a rectangular shaped outer frame are retained with the vertical edges of the frame parallel to the vertical edges of other adjacent objects hanging on the wall and to the vertical edges of the wall itself, and that the horizontal edges of the objects are parallel to the horizon and parallel to the horizontal edges of other adjacent objects hanging on the wall. That is, for objects to be positioned on a wall in an aesthetically pleasing manner, it is desirable for the objects to be hung square to the floor and/or ceiling.

Where a rectangular object, such as a photograph, painting, or mirror is to be retained on the wall by a plurality of retainers (e.g., loops) mounted to a rearward surface of the object, a corresponding plurality of hooks (e.g., nails, picture hooks, etc.) must be positioned on the wall to engage the retainers and retain the object in its desired orientation.

Unfortunately, most of the retainers on the rearward surface of an object to be mounted on a wall are not positioned along a line parallel to an upper edge or surface of the object. That is, in most instances, retainers on the rearward surface of an object are not attached to the object at the same distance from the upper edge of the object. Accordingly, if an installer of an object attaches two hooks (e.g., nails) to a wall such that the hooks are attached on a level line (e.g., a line connecting the hooks is level and/or parallel to the floor/ceiling) with a spacing therebetween sufficient to engage the retainers of the frame, it is likely that the edges of the frame will not be square with the floor and/or ceiling. In order to position a rectangular frame having a number of loops thereon against a wall, it is therefore necessary to make numerous, tedious, and highly accurate, measurements to find the proper positioning for the retaining hooks to hold the frame if the mounted frame is to be properly (e.g., square) oriented on the wall. The present disclosure is directed towards satisfying these and other needs.

SUMMARY OF THE INVENTION

The present disclosure is directed towards a device for hanging a frame member (e.g., a picture frame) against a wall where the frame member has an upper edge, an opposing lower edge, two opposing side edges, a rearward surface, and two or more spaced apart retainers attached to the rearward surface. The device includes a crossbar and one or more arms (e.g., one arm, two arms, three arms, etc.) operatively coupled to the crossbar.

The crossbar has a longitudinal edge, a track parallel to the edge, and a leveling bubble with markings thereon that are indicative of a horizontal orientation of the longitudinal edge. For example, the level bubble can be used to determine if the crossbar and/or the longitudinal edge are level (e.g., parallel with horizontal/horizon).

A first one of the arms has a length and a linear track (e.g., slot) that extends along a majority portion of the length of the arm, and a marker (e.g., pin) extending from a front surface of the arm. Second and/or third arms identical to the first arm can further be included in the device.

Each arm is coupled to the crossbar via a respective knuckle having a guide for engaging the linear track of the arm wherein the length of the arm is retained substantially perpendicular to the linear edge of the crossbar and the arm is longitudinally moveable (e.g., slidable in a longitudinal fashion) in the direction perpendicular to the linear edge. Each arm can be held in contact with the knuckle via a respective fastener assembly (e.g., a knob screw assembly). Additional identical knuckles can be provided for coupling additional arms to the crossbar.

According to some implementations of the present disclosure, a device for hanging an object on a wall includes a crossbar, one or more knuckles, one or more arms, and one or more end caps. The crossbar includes a track extending between two opposing ends of the crossbar. The knuckle is slidably coupled to the crossbar such that the knuckle is slidable in a first direction. The knuckle includes a projection that has a pair of parallel sides. The arm has a marking pin that projects generally perpendicular from a forward surface of the arm. The arm is coupled to the crossbar via the knuckle such that the arm is slidable along the pair of parallel sides of the projection in a second direction. The end cap is coupled to one of the two opposing ends of the crossbar. The end cap includes an "L" bracket that provides an engagement surface for engaging a corner of a second object previously hung on the wall.

Additional aspects of the present disclosure will be apparent to those of ordinary skill in the art in view of the detailed description of various implementations, which is made with reference to the drawings, a brief description of which is provided below.

Figure 1:
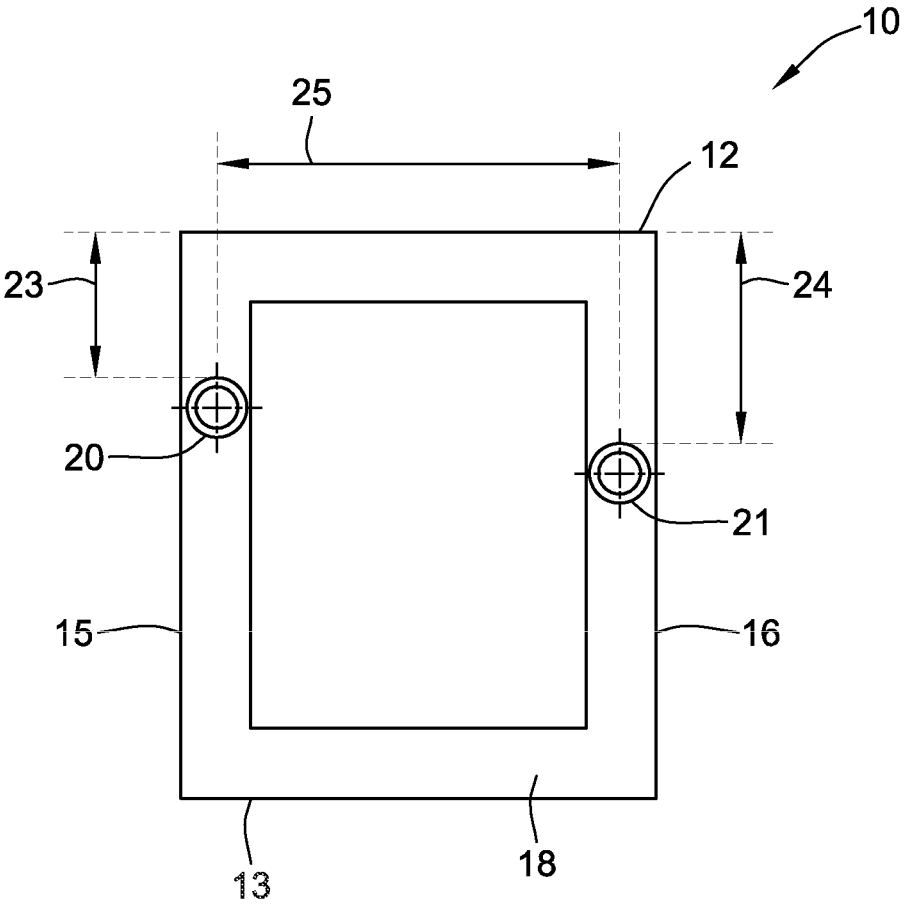
FIG. 1 Related Art
FIG. 1 is a top view of a back side of an object to be hung on a wall.

While the present disclosure is susceptible to various modifications and alternative forms, specific implementations have been shown by way of example in the drawings and will be described in detail herein. It should be understood, however, that the present disclosure is not intended to be limited to the particular forms disclosed. Rather, the disclosure is to cover all modifications, equivalents, and alternatives falling within the spirit and scope of the present invention as defined by the appended claims.

DETAILED DESCRIPTION

While this disclosure is susceptible of embodiment in many different forms, there is shown in the drawings and will herein be described in detail preferred embodiments of the disclosure with the understanding that the present disclosure is to be considered as an exemplification of the principles of the disclosure and is not intended to limit the broad aspect of the disclosure to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

As used herein, the term horizontal is used to refer to an item (e.g., surface, edge, etc.) being horizontal relative to earth. As used herein, the term vertical is used to refer to an item (e.g., surface, edge, etc.) being vertical relative to earth. Thus, a first item that is described herein as being horizontal is generally perpendicular to a second item that is described herein as being vertical.

Referring to FIG. 1, an object 10 has a generally linear upper edge 12, a generally linear opposing lower edge 13, parallel spaced apart generally linear side edges 15, 16, and a rear surface 18 with one or more attachment loops 20, 21 attached thereto. The attachment loops 20 are suitable for engaging respective hooks (not shown) (e.g., nails, picture hooks, etc.) attached to a wall in order to retain the object 10 against the wall. As shown in FIG. 1, two attachment loops 20 are provided on the rearward surface 18 of the object; however, in some implementations, a wire can extend between the loops 20, 21 and a single hook on the wall can engage the wire to retain the object thereon. By moving the engagement position of the wire on the hook, the object 10 can be oriented such that the upper edge 12 is horizontal (e.g., such that the object is square). The object can be, for example a painting, a framed photograph, a mirror, or the like, suitable for hanging on a wall. While the object 10 is shown as having a generally rectangular shape, the object may have any shape (e.g., round, oval, square, triangular, etc.).

Where no wire extends between the loops 20, 21, a corresponding set of hooks (not shown) must be mounted on the wall and positioned to engage the attachment loops 20, 21, thereby holding the object 10 against the wall. Such a mounting configuration (e.g., two loops with two corresponding hooks on the wall) is preferred over using a wire configuration with one hook on the wall to minimize creep and/or movement of the object 10 on the wall over time. As shown in FIG. 1, the attachment loops 20, 21 are generally not attached to the rearward surface 18 of the object at equal distances from the upper edge 12. As shown, the first loop 20 is attached to the rearward surface 18 at a first distance 23 from the upper edge 12 and the second loop 21 is attached to the rearward surface 18 at a second distance 24 from the upper edge 12. The first and the second distances 23, 24 are not equal. Additionally, the loops 20, 21 are horizontally positioned apart from one another a third distance 25. Thus, the hooks (e.g., nails) that support the object 10 on a wall (not shown) must therefore be positioned the third distance 25 apart from one another in order to properly engage the hooks 20, 21. Also, if the object 10 is to be mounted on a wall (not shown) with the upper edge 12 a certain distance from the ceiling or the floor in a square manner (e.g., parallel with the floor and/or ceiling), the hook that engages the first loop 20 must be attached to the wall at the first distance 23 from the desired location of the upper edge 12, and the hook that engages the second loop 21 must be attached to the wall at the second distance 24 below the desired location of the upper edge 12. Without using the device described in the present disclosure, one must carefully record all the forgoing measurements and map their location in a mirror image fashion upon the wall (e.g., using a pencil) before attaching the hooks to the wall that will receive the loops 20, 21 if the object 10 is to have a desired orientation on the wall (e.g., square to the floor and/or ceiling).

Figure 2:
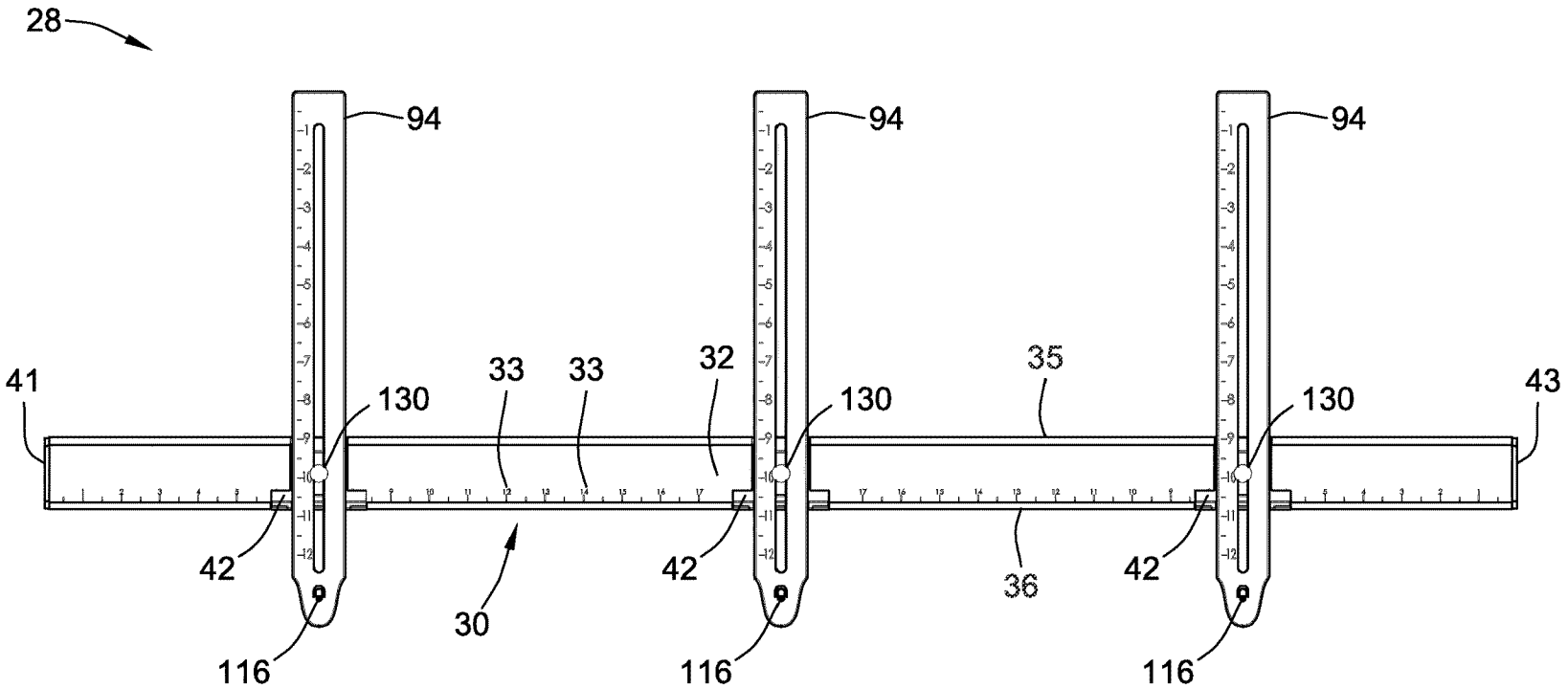
FIG. 2 is a front view of a device for hanging the object of FIG. 1 according to some implementations of the present disclosure.
Figure 3:
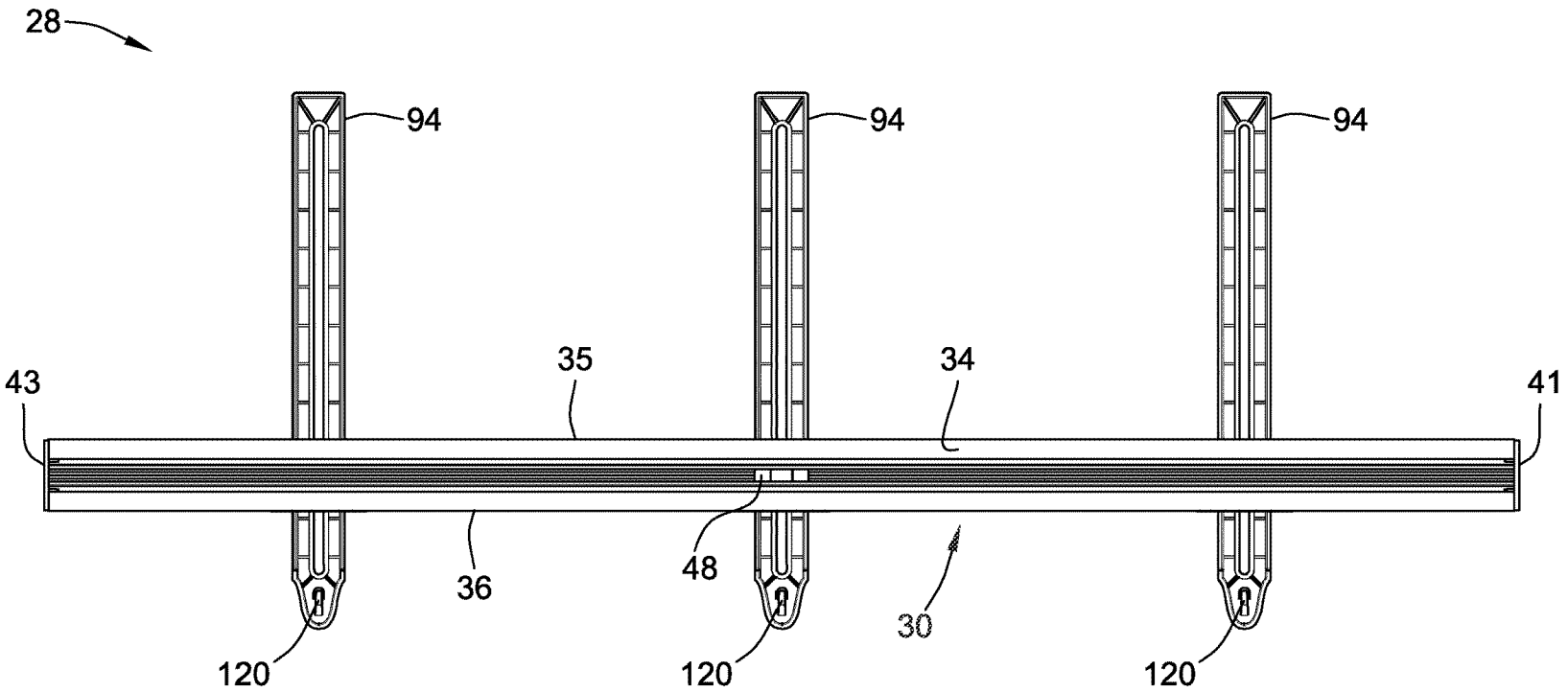
FIG. 3 is a back view of the device of FIG. 2.
Figure 4:
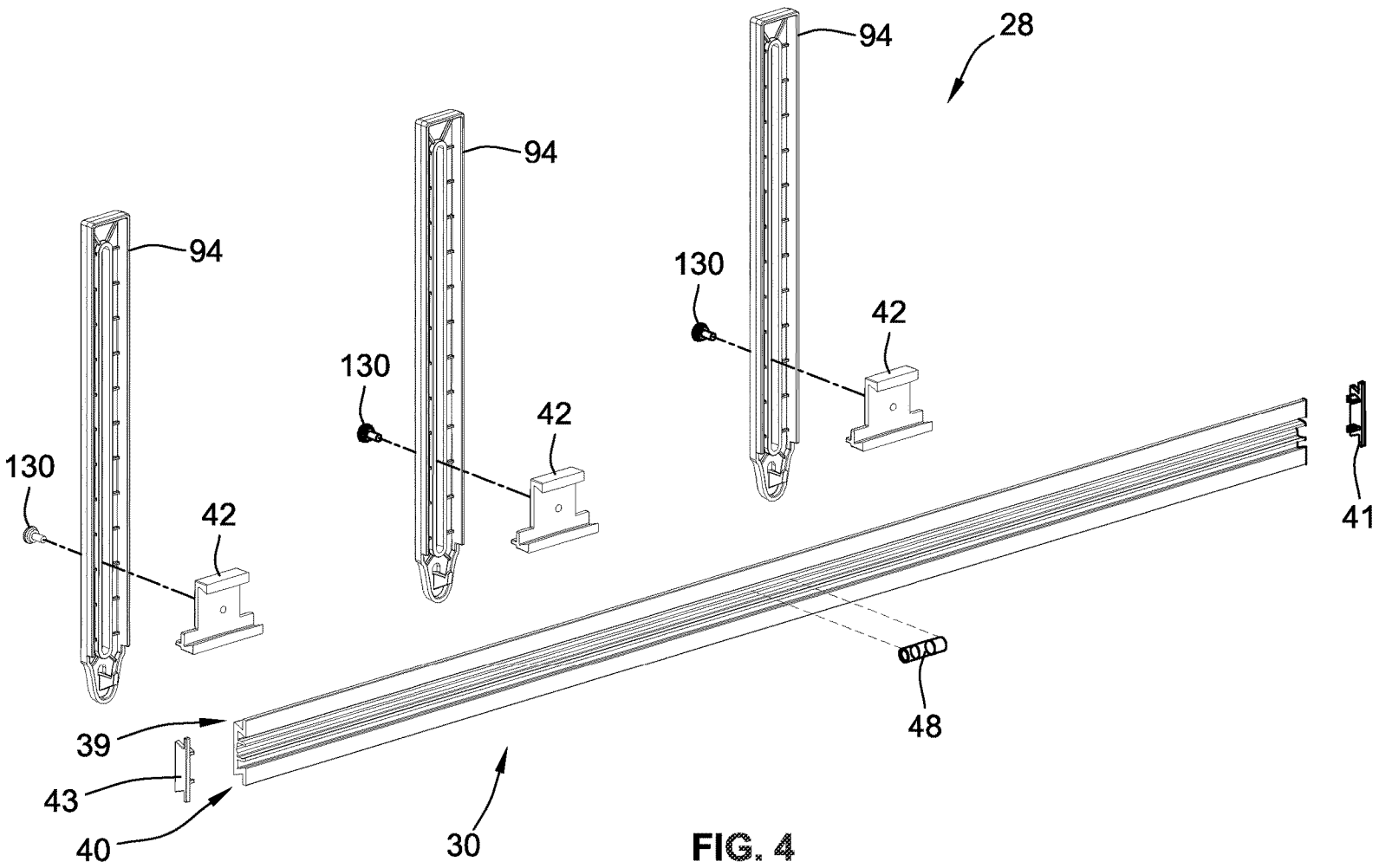
FIG. 4 is an exploded perspective view of the device of FIG. 3.

Referring generally to FIGS. 2, 3, and 4, a device 28 for use in properly positioning (e.g., squarely) the object 10 on a wall is shown in accordance with the present disclosure. The device 28 includes a generally horizontal elongated rigid crossbar 30 and vertically oriented elongates rigid arms 94. While three arms 94 are shown, the device 28 can include any number of arms (e.g., one arm, two arms, etc.). Further, while the device 28 includes the three identical arms 94, in some implementations, one or more of the arms 94 can be different. For example, one of the arms 94 can be longer, shorter, wider, narrower, etc. than the other arms.

The crossbar 30 has a forward surface 32 (FIG. 2), a rearward surface 34 (FIG. 3), and parallel opposing upper and lower sides 35, 36 (FIGS. 2 and 3). End caps 41, 43 (best shown in FIG. 4) can be coupled (e.g., in a removable manner or a non-removable manner) to opposing ends of the crossbar 30 for aesthetically covering the ends thereof. The end caps 41, 43 can be press fit and/or slid into the ends of the crossbar 30. Alternatively, the end caps 41, 43 can be integrally formed with the crossbar 30 such that the end caps 41, 43 and the crossbar 30 are formed in a single operation (e.g., a single injection molding process).

Dimensional markings 33 (FIG. 2) are provided along one or both of the sides 35, 36 of the crossbar 30. Preferably the dimensional markings 33 designate the longitudinal center of the crossbar as the "zero" dimension (e.g. origin), with the markings in inches (or other commonly used dimensions such as centimeters) extending incrementally towards both of the end caps 41, 43.

Each of the sides 35, 36 of the crossbar 30 includes an elongate groove 39, 40 (best shown in FIG. 4) respectively therein, with the grooves 39, 40 forming a track for slideably receiving a multitude of knuckles 42, which are further described below. Positioned along the rearward surface 34 (FIG. 3) of the crossbar 30 is a level bubble 48 having markings thereon indicative of the sides 35, 36 being horizontally oriented. Put another way, the level bubble 48 can be used to determine if the crossbar 30 is level or square with horizontal.

Figure 5:
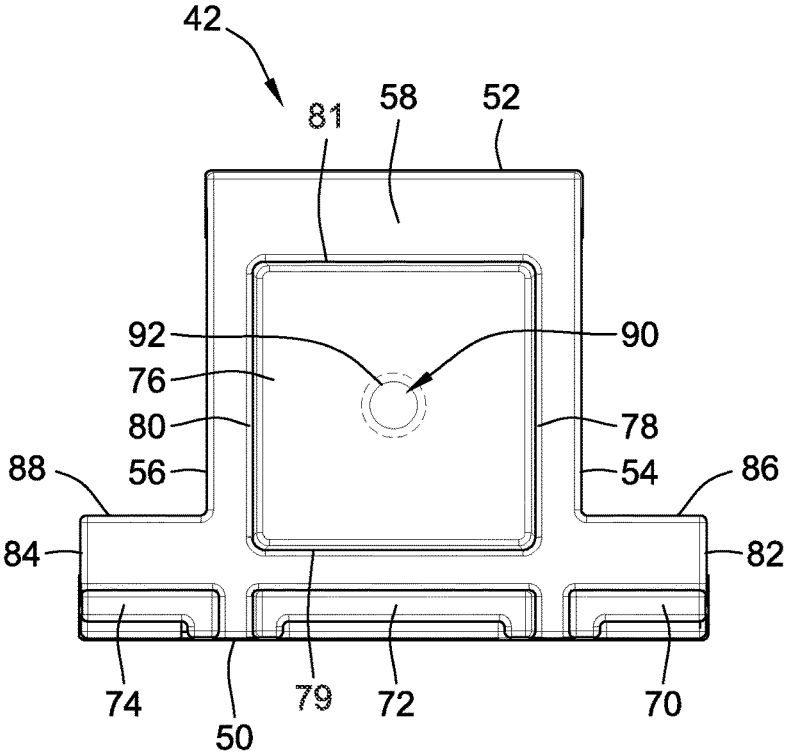
FIGS. 5-7 are various views of a knuckle of the device of FIG. 2.
Figure 6:
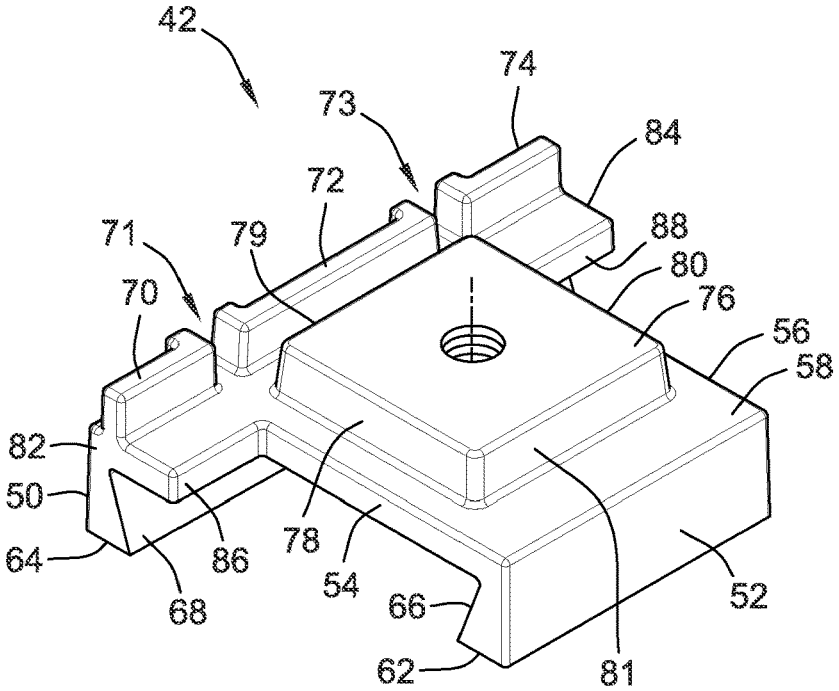
Figure 7:
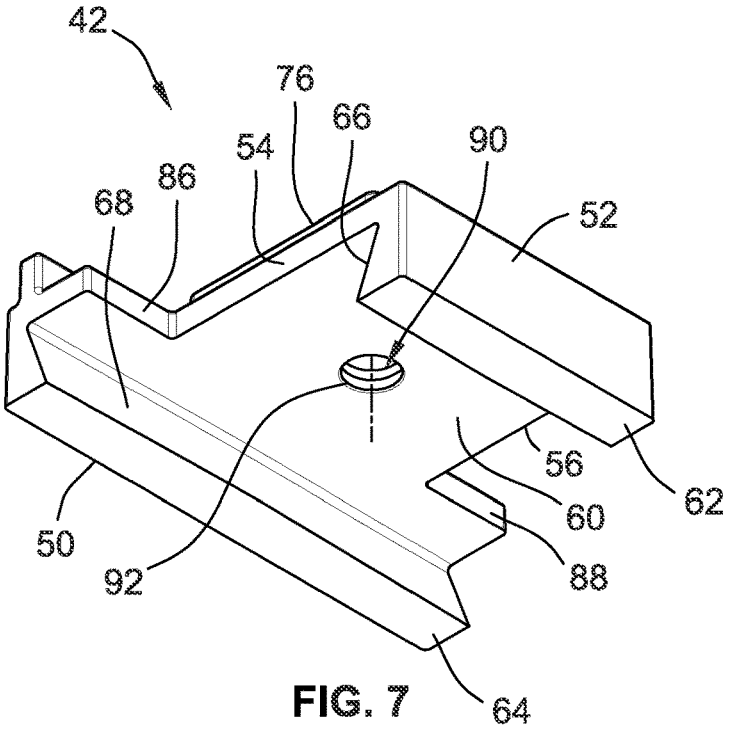

Referring generally to FIGS. 5, 6, and 7, each of the knuckles 42 has a generally rectangular body with an upper edge 52, a lower edge 50, parallel sides 54, 56, a forward surface 58 (FIGS. 5 and 6), and a rearward surface 60 (FIG. 7). As best shown in FIG. 7, parallel upper and lower flanges 62, 64 extend rearwardly from the rearward surface 60 of the knuckle 42. The upper flange 62 has a ramped surface 66 that is complementary to (e.g., corresponds with) the surface of the groove 39 (FIG. 4) along the upper side 35 of the crossbar 30. Similarly, the lower flange 64 has a ramped surface 68 that is complementary to (e.g., corresponds with) the surface of the groove 40 (FIG. 4) along the lower side 36 of the crossbar 30. Accordingly, the flanges 62, 64 and surfaces 66, 68 of the knuckle 42 are received in and/or about the track formed by the grooves 39, 40 such that the knuckle 42 is longitudinally slideable along the track of crossbar 30.

As best shown in FIG. 6, along the lower edge 50 of the knuckle 42, projections 70, 72, 74 extend from the forward surface 58. Additionally, a fourth projection 76 extends from a central location of the forward surface 58 of the knuckle 42. A first gap 71 is formed between the first and the second projections 70 and 72 and a second gap 73 is formed between the second and the third projections 72 and 74. The fourth projection 76 has a first pair of parallel sides 78, 80 (FIGS. 5 and 6). The first pair of parallel sides 78 and 80 align with the outer ends/sides of the projection 72 such that the parallel sides 78, 80 and the gaps 71, 73 between the projections 70, 72, and 74 form a track for slideably receiving one of the arms 94 therein in a first assembled configuration of the device 28 as is further described below.

The fourth projection 76 further has a second pair of parallel sides 79, 81 (FIGS. 5 and 6). The second pair of parallel sides 79 and 81 align with the inner surfaces of the projections 70, 72, 74 such that the parallel sides 79, 81 and the inner surfaces of the projections 70, 72, 74 form a track for slideably receiving one of the arms 94 therein in a second storage configuration of the device 28 as is further described below.

As best shown in FIG. 5, shoulders 82, 84 extend outward of the sides 54, 56 of the knuckle 42 resulting in the lower edge 50 of knuckle 42 being longer than the upper edge 52 of the knuckle 42. A first one of the shoulders 82 has a linear upper edge 86 (best shown in FIG. 6) that extends parallel to the upper and lower edges 52, 50 of the knuckle 42. Similarly, a second one of the shoulders 84 has a linear upper edge 88 (best shown in FIG. 6) that extends parallel to the upper and lower edges 52, 50 of the knuckle 42. A portion of the lower edge 50 corresponding with the shoulders 82, 84 can be used to aid in aligning adjacent objects (e.g., object 10) on a wall as is further described below (e.g., hanging two pictures with an upper edge of each picture at the same height).

A transverse threaded hole 90 is centrally located in the fourth projection 76 and extends through the forward surface 58 (FIGS. 5 and 6) and the rearward surface 60 (FIG. 7) of the knuckle 42. In some implementations, a tubular metal sleeve 92 (FIG. 5) is bonded (e.g., press fit, glued, etc.) into a transverse bore in the knuckle 42 and the threaded hole 90 is the central opening in the sleeve 92.

Figure 8:
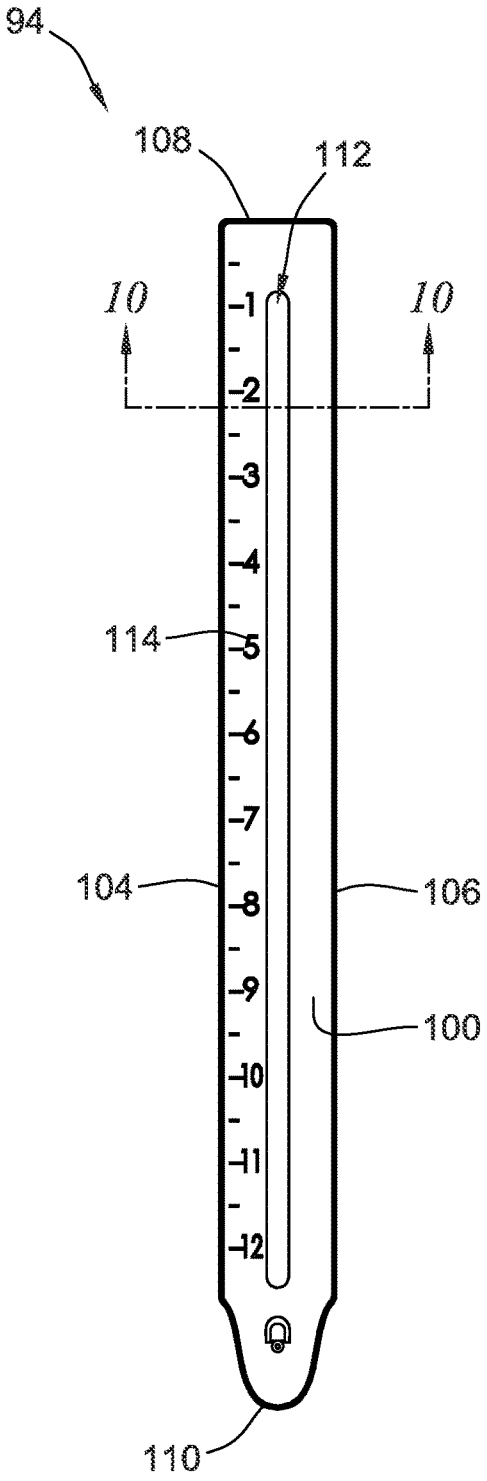
Figure 9:
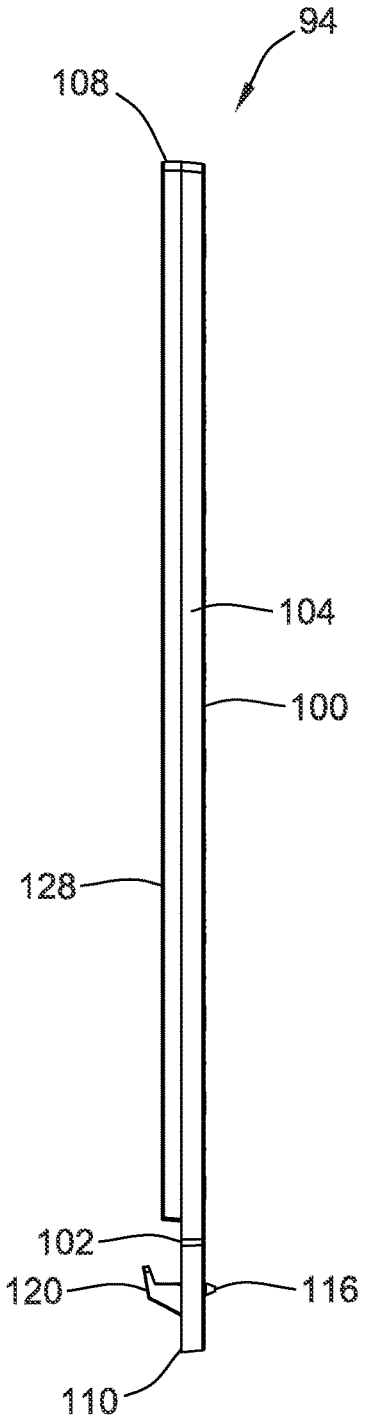

Referring to FIGS. 8-11, each of the arms 94 has a forward surface 100 (FIGS. 8 and 9), a rearward surface 102 (FIGS. 9-11), parallel linear sides 104, 106 (FIGS. 8 and 10), and upper and lower ends 108, 110 (FIGS. 8 and 9). An elongated slot 112 (FIGS. 8 and 10) extends longitudinally through a majority portion of the length of the arm 94, penetrating through the forward surface 100 and the rearward surface 102 with the edges of the slot 112 being generally equally spaced from the sides 104, 106 (e.g., the slot 112 is centered in the width or narrow dimension of the arm 94). Extending along one of the sides 104 of the arm 94 are dimensional markings 114 (FIG. 8) with a zero point (e.g., origin) starting at the upper end 108 of the arm 94.

Figure 11:
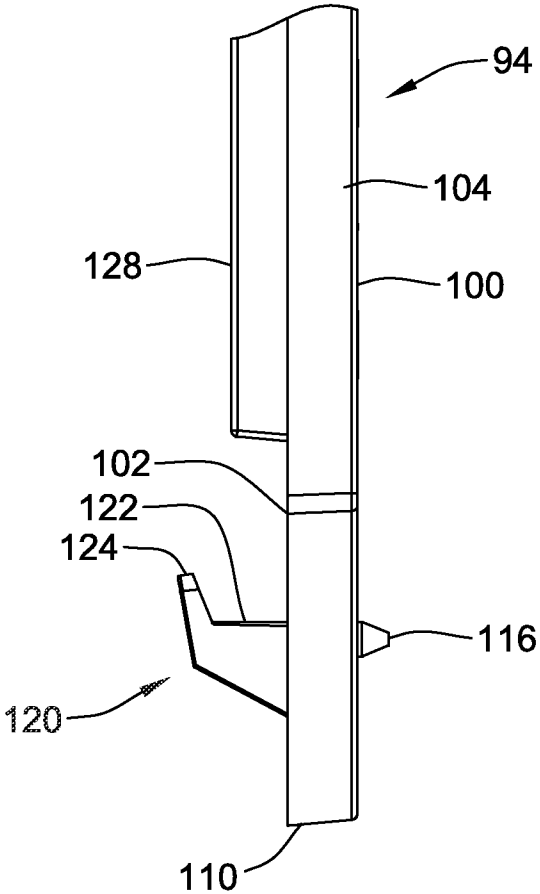
FIG. 11 is an enlarged partial side view of the arm of FIG. 9.

As best shown in FIG. 11, extending substantially perpendicular to the forward surface 100 of the arm 94 and adjacent to the lower end 110 is a marking pin 116. The marking pin 116 includes an outer end that is generally conical in shape and converges to a pointed end. The marking pin 116 can be made of metal, plastic, or any suitable material, such that the marking pin 116 is suitable for being pressed into a surface (e.g., a wall) to make an indentation therein (e.g., making an indentation in drywall covered with paint and/or wall paper).

Extending from the rearward surface 102 of the arm and adjacent to the lower end 110 is a hook 120. The hook 120 has a generally planar retaining surface 122 and a hook end 124. The hook 120 is used to engage (e.g., hook onto), for example, a loop (e.g., loops 20, 21) of an object (e.g., object 10) when using the device 28 to aesthetically hang the object on a wall as described below. After the loop is captured on the hook 120, the loop is caused to rest on the retaining surface 122. In some implementations, the hook 120 can be positioned such that the retaining surface 122 is directly opposite the marking pin 116. Put another way, the retaining surface 122 can be coplanar with an uppermost surface of the marking pin 116.

Figure 10:
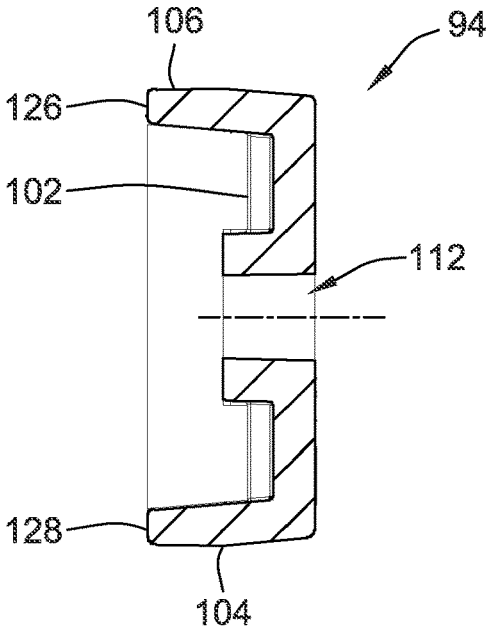
FIGS. 8-10 are various views of an arm of the device of FIG. 2.

As best shown in FIG. 10, the arm 94 has a pair of rearwardly extending parallel flanges 126, 128 that extend from the rearward surface 102 and along the sides 104, 106 (FIG. 8) of the arm 94. The flanges 126, 128 are spaced apart such that the spacing between the flanges 126, 128 is substantially equal to the distance between the first pair of parallel sides 78, 80 (FIGS. 5 and 6) of the fourth projection 76 of the knuckle 42. Similarly, the flanges 126, 128 are spaced apart such that the spacing between the flanges 126, 128 is substantially equal to the distance between the second pair of parallel sides 79, 81 (FIGS. 5 and 6) of the fourth projection 76 of the knuckle 42. Further, each of the flanges 126, 128 has a thickness that is slightly less than (e.g., 0.1 inches less, 10 mils less, etc.) the distance of the gaps 71 and 73 of the knuckle 42. Accordingly, the projections 72 and 76 (FIG. 6) on the forward surface 58 of the knuckle 42 are slideably receivable between the flanges 126, 128 (FIG. 10) extending from the rearward surface 102 of arm 94. Likewise, the flanges 126, 128 of the arm 94 are slideably receivable between the first and the third projections 70, 74 of the knuckle 42.

Figure 12:
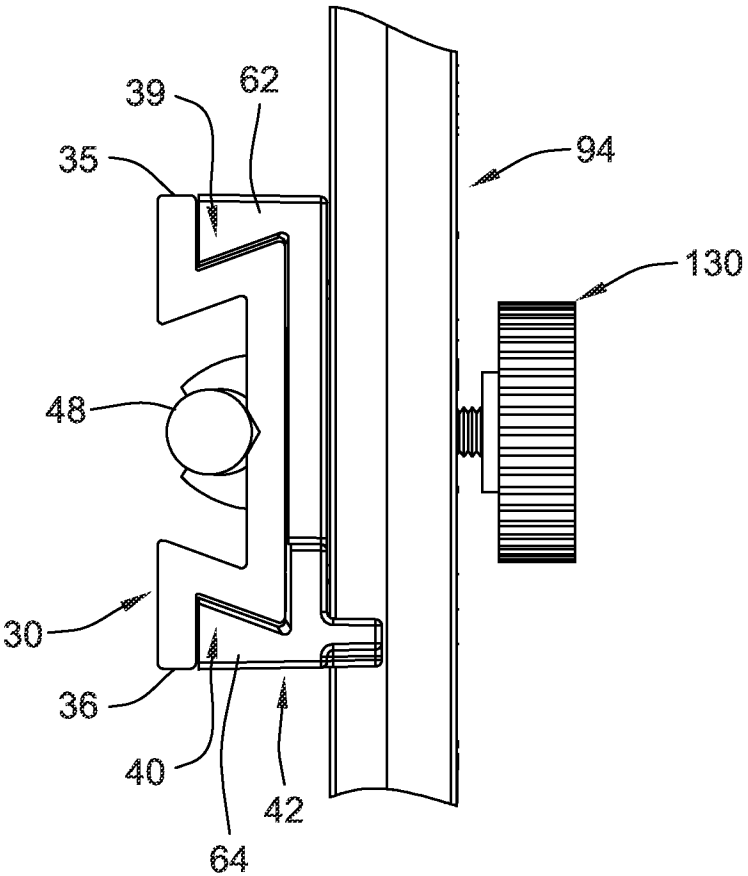
FIG. 12 is an enlarged partial side view of the device of FIG. 2.
Figure 14:
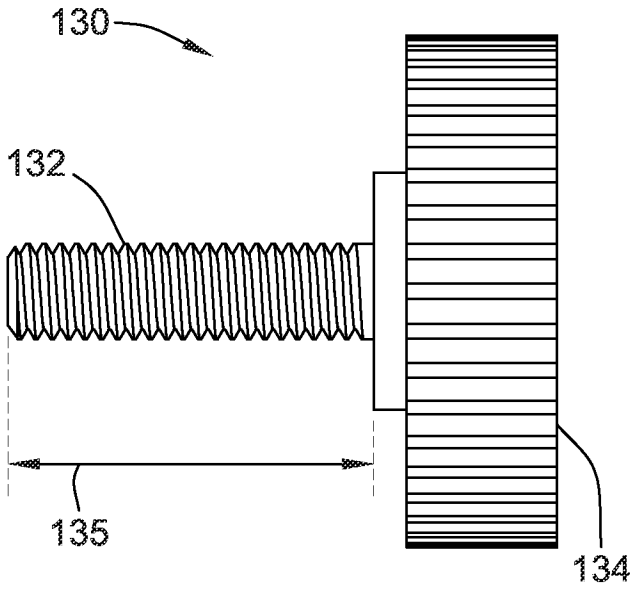
FIG. 14 is a side view of a knob screw of the device of FIG. 2.
Figure 13:
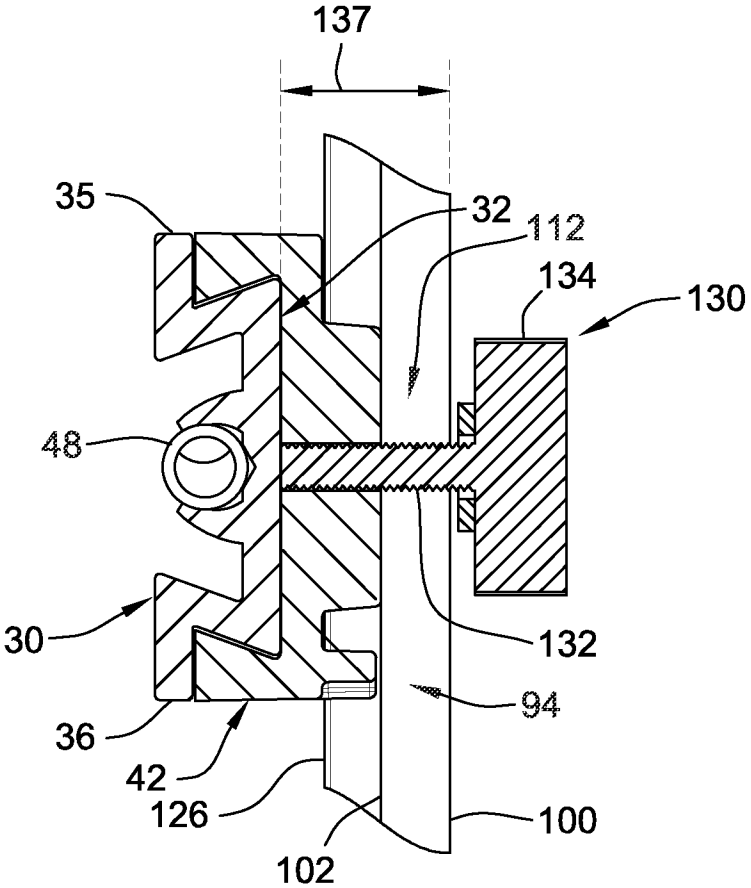
FIG. 13 is an enlarged partial cross-sectional side view of the device of FIG. 2.

Referring generally to FIGS. 12-14, in some implementations, the arms 94 can be removably coupled to the crossbar 30 with the knuckles 42 therebetween by means of an adjustment knob screw 130 (e.g., thumb screw). As best shown in FIG. 14, the knob screw 130 has a threaded shank 132 and a head 134. The threaded shank 132 has a length 135 and includes threads along the length 135 that are complementary to the threaded hole 90 in the knuckle 42 (FIG. 5). The head 134 of the knob screw 130 has an outer diameter that is greater than the width of the slot 112 of the arms 94 (FIG. 8).

To removably retain the arm 94 to the crossbar 30 with the knuckle 42 therebetween (best shown in FIGS. 12 and 13), the threaded shank 132 of the knob screw 130 is extended through the slot 112 (FIGS. 8 and 13) of the arm 94 and into the threaded hole 90 (FIG. 5) of the knuckle 42 and tightened (e.g., screwed in). When the knob screw 130 is fully tightened, the knob screw 130 retains a portion of the flanges 126, 128 (FIG. 10) of the arm 94 against the forward surface 58 (FIG. 5) of the knuckle 42 preventing relative motion of the arm 94 and knuckle 42. Additionally, when the knob screw 130 is fully tightened, the knob screw 130 retains the ramped surfaces 66, 68 (FIGS. 6 and 7) of the upper and lower flanges 62, 64 of the knuckle 42 against the surfaces of the elongated grooves 39, 40 of the crossbar 30, thereby preventing relative motion of the knuckle 42 and the crossbar 30. Further, when the knob screw 130 is fully tightened, the projection 76 (FIG. 6) with parallel sides 78, 80 is positioned between the flanges 126, 128 (FIG. 10) of the arm 94 to aid in retaining the arm 94 with the linear sides 104, 106 (FIG. 8) of the arm 94 oriented generally perpendicular to the upper and lower sides 35, 36 (FIG. 2) of the crossbar 30.

In order to removably retain the arm 94 to the crossbar 30 as described above, the length 135 of the threaded shank 132 (FIG. 14) of the knob screw 130 is designed to be slightly longer (e.g., 0.1 inches longer, 10 mils longer, etc.) than a distance 137 (FIG. 13) between the forward surface 100 of the arm 94 and the forward surface 32 of the crossbar 30 when the arm 94 is coupled to the crossbar 30 as shown in FIGS. 12 and 13. As a result, when the screw 130 is tightened (e.g., threaded into) in the threaded hole 90, the distal end of the threaded shank 132 contacts the forward surface 32 (best shown in FIG. 2) of the crossbar 30 before the head 134 tightens against the forward surface 100 of the arm 94. However, when the knob screw 130 is in a loosened condition (e.g., not completely tightened), the knuckle 42 is slideable along crossbar 30 and the associated arms 94 are vertically slideable with respect to knuckle 42. Tightening the knob screw 130 until the end of threaded shank 132 contacts the crossbar 30 (FIG. 13) locks the knuckle 42 with respect to the crossbar 30 (e.g., the knuckle is prevented from sliding along the crossbar 30), but still permits the arm 94 to slide along the slot 112 with respect to the knuckle 42. However, further tightening of the knob screw 130 causes the distal end of the shank 132 to indent into the forward surface 32 of the crossbar 30 and compress the head 134 against the forward surface 100 of the arm 94, thereby locking the arm 94 and preventing movement of the arm 94 with respect to the knuckle 42. Thus, providing and/or designing a threaded shank (e.g., threaded shank 132) with a length that is a little longer than the distance between the forward surface 100 of the arm 94 and the forward surface 32 of crossbar 30 permits the arm 94 to independently tighten down as the knob screw 130 is tightened.

The device 28 of the present disclosure (in its assembled position as shown in FIGS. 2 and 3) can be used to mount the object 10 (FIG. 1) against a wall (not shown) as follows. Initially, the crossbar 30 is positioned such that the lower side 36 of the crossbar 30 abuts the upper edge 12 of the object 10. The hooks 120 (FIG. 11) of two of the arms 94 are positioned to engage respective ones of the loops 20, 21 of the object 10 such that the loops 20, 21 rest on the retaining surfaces 122 of the respective hooks 120. Once the arms 94 are properly aligned with the hooks 120 and engaging the loops 20, 21, the heads 134 of knob screws 130 for both arms 94 are tightened thereby locking the arms 94 in their desired orientation with respect to the crossbar 30. Thereafter, the device 28 is disengaged from the object 10 (e.g., the hooks 120 are removed from the loops 20, 21) and the device 28 is moved to a wall against which the object 10 is to be hung without changing the orientation of the arms 94 or the knuckles 42. The lower side 36 of the crossbar 30 is then located on the wall where the upper edge 12 of the object is to be positioned and the marking pins 116 are pressed against the surface of the wall by, for example, pressing on the hooks 120, which leaves indentations in the wall. Hooks (e.g., nails, picture hooks, etc.) are attached to the wall at the location of the indentations on the wall. Then, the object 10 can be hung on the wall by engaging the loops 20, 21 of the object 10 with hooks attached to the wall.

In a similar fashion, the hook 120 of one of the arms 94 can be used individually to engage a wire extending between the attachment loops 20, 21 to position a hook on the wall to engage the wire and retain the object 10 in the desired location. The dimensional markings 33 (FIG. 2) can aid the user to position the vertical member 96 midway between the sides 15, 16 (FIG. 1) of the object 10.

In some implementations, the dimensional markings 33 on the crossbar 30 can be used in conjunction with the shoulder 82 on the right side of a first one of the knuckles 42 (FIG. 5) and the shoulder 84 on the left side of a second one of the knuckles 46 to position the side 15, 16 (FIG. 1) of the object 10 a fixed distance from the sides of a second object (not shown), such that a plurality of objects can be positioned on a wall with equal spacing between the sides of the objects. Similarly, the dimensional markings 114 on the arms 94 can be used to vertically offset a second object 10 with respect to a first object.

As described above, the arms 94 are moveable along the length of the crossbar 30 and in a direction perpendicular to the crossbar 30. However, in some implementations, one or more of the arms 94 can be rigidly fixed to the crossbar 30 such that the arm 94 cannot move relative to the crossbar 30. Referring generally to FIGS. 15-19, a device 200 includes a generally horizontal elongated rigid crossbar 230, a fixed arm 294*a*, and an adjustable arm 294*b*. The crossbar 230 has linear upper and lower edges 231, 232, a forward surface 233 (FIG. 15), and a rearward surface 234 (FIG. 16). Centrally positioned so that it is readable when viewing the rearward surface 234 is a level bubble 240 oriented to be centrally aligned when the upper and lower edges 231, 232 of the crossbar 230 are horizontal. As best shown in FIG. 18, the upper and lower edges 231, 232 each have angled surfaces 236, 237 (FIG. 18) therein to form a track similar to the track of crossbar 30 described above.

Figure 15:
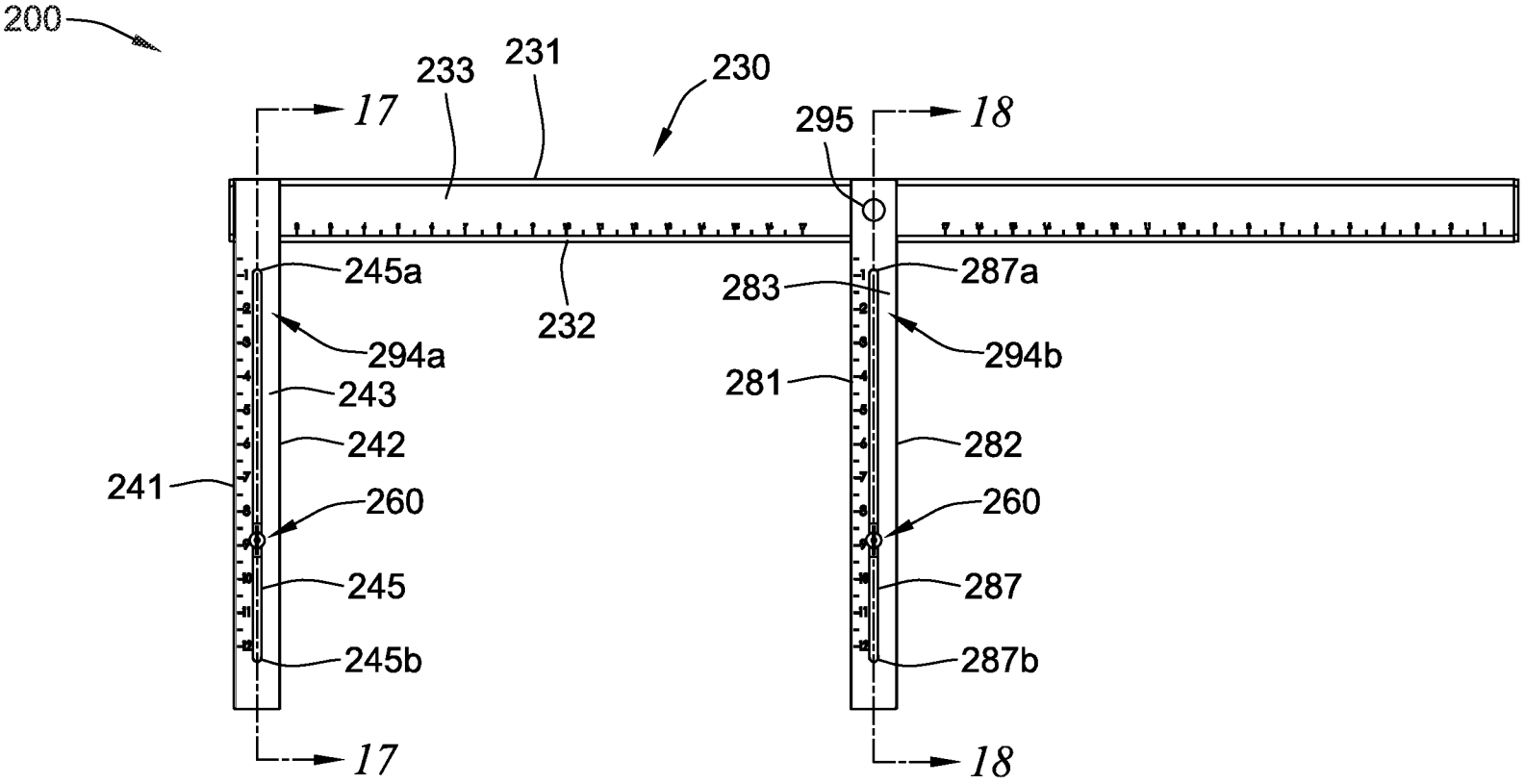
FIG. 15 is a front view of a device for hanging the object of FIG. 1 according to some implementations of the present disclosure.
Figure 16:
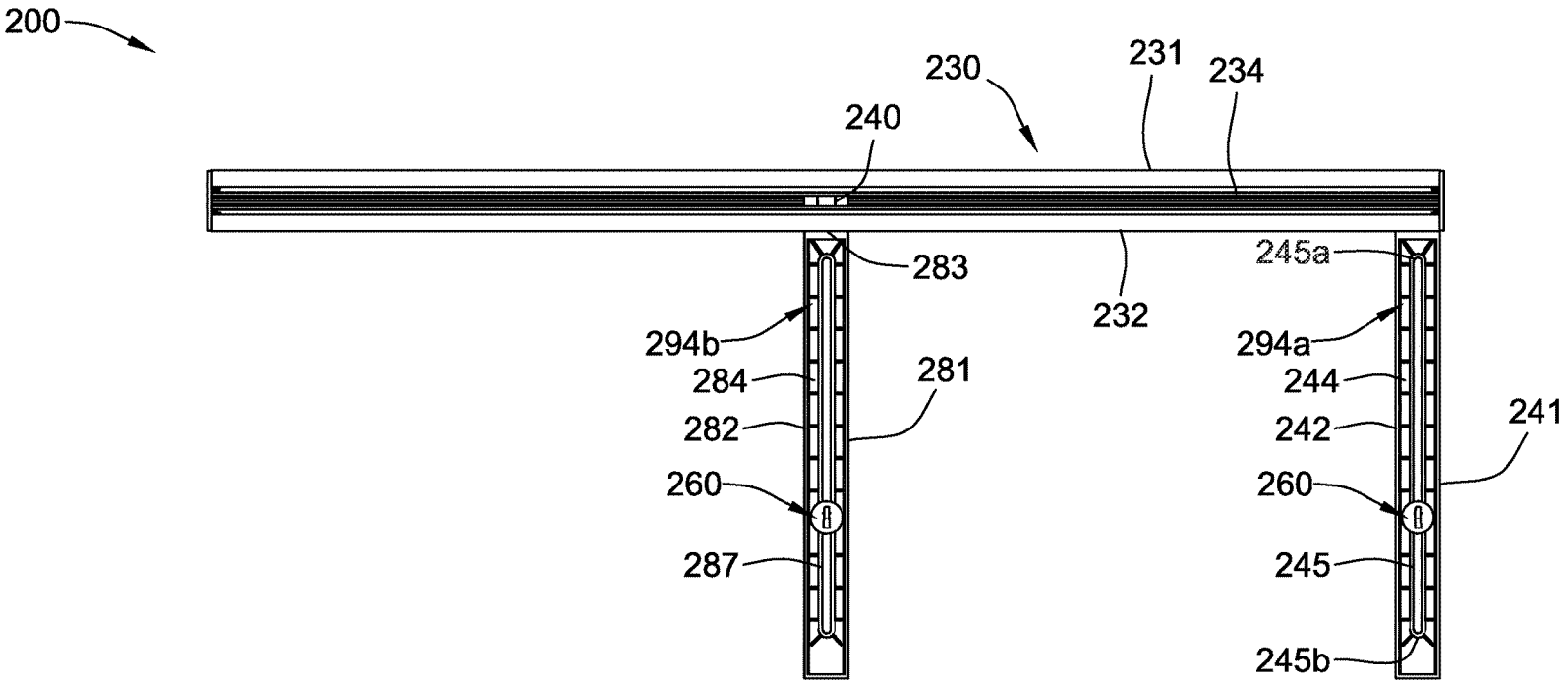
FIG. 16 is a back view of the device of FIG. 15.

As best shown in FIG. 15, extending downwardly from one end of the crossbar 230 is the fixed arm 294*a* having opposing linear side edges 241, 242 (FIGS. 15 and 16) oriented perpendicular to the upper and lower edges 231, 232 of the crossbar 230. The fixed arm 294*a* further has a forward surface 243 (FIG. 15) and a rearward surface 244 (FIG. 16). An elongated slot 245 (FIGS. 15 and 16) is positioned through the forward surface 243 and the rearward surface 244. The slot 245 has parallel sides that extend parallel to the side edges 241, 242. The slot 245 has an upper end 245*a* and a lower end 245*b*.

Figure 17:
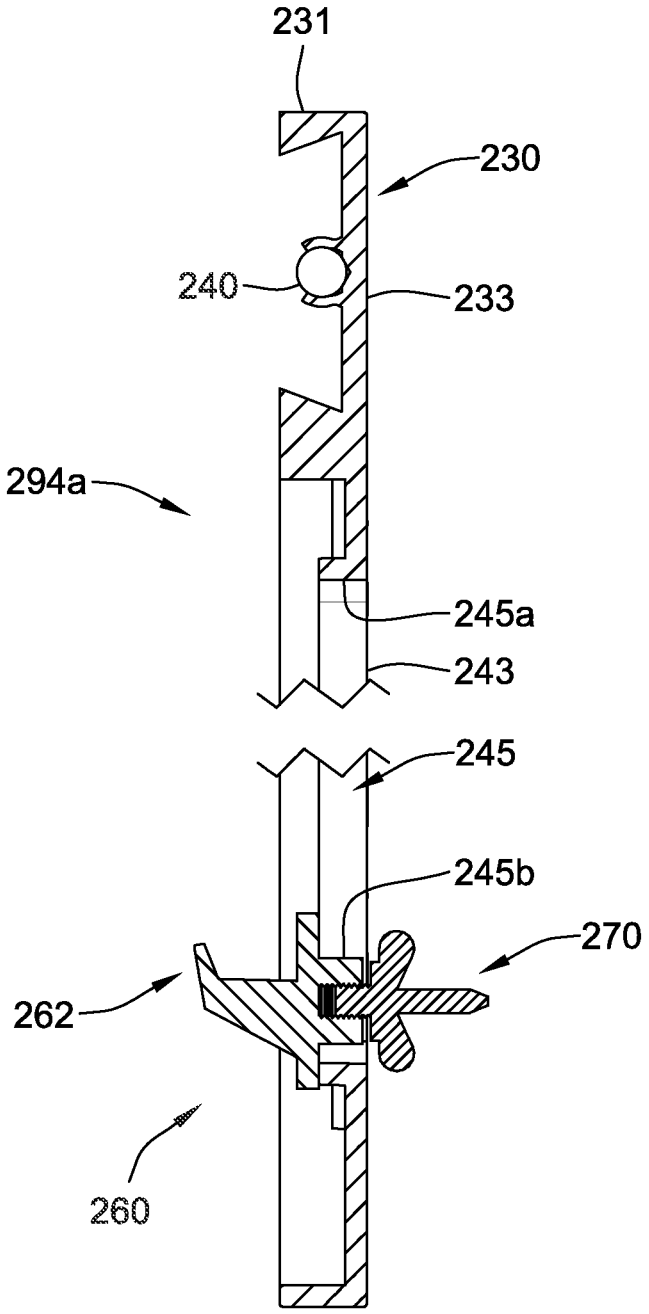
FIG. 17 is an enlarged partial cross-sectional view of the device of FIG. 15 taken through lines 17-17 thereof.
Figure 18:
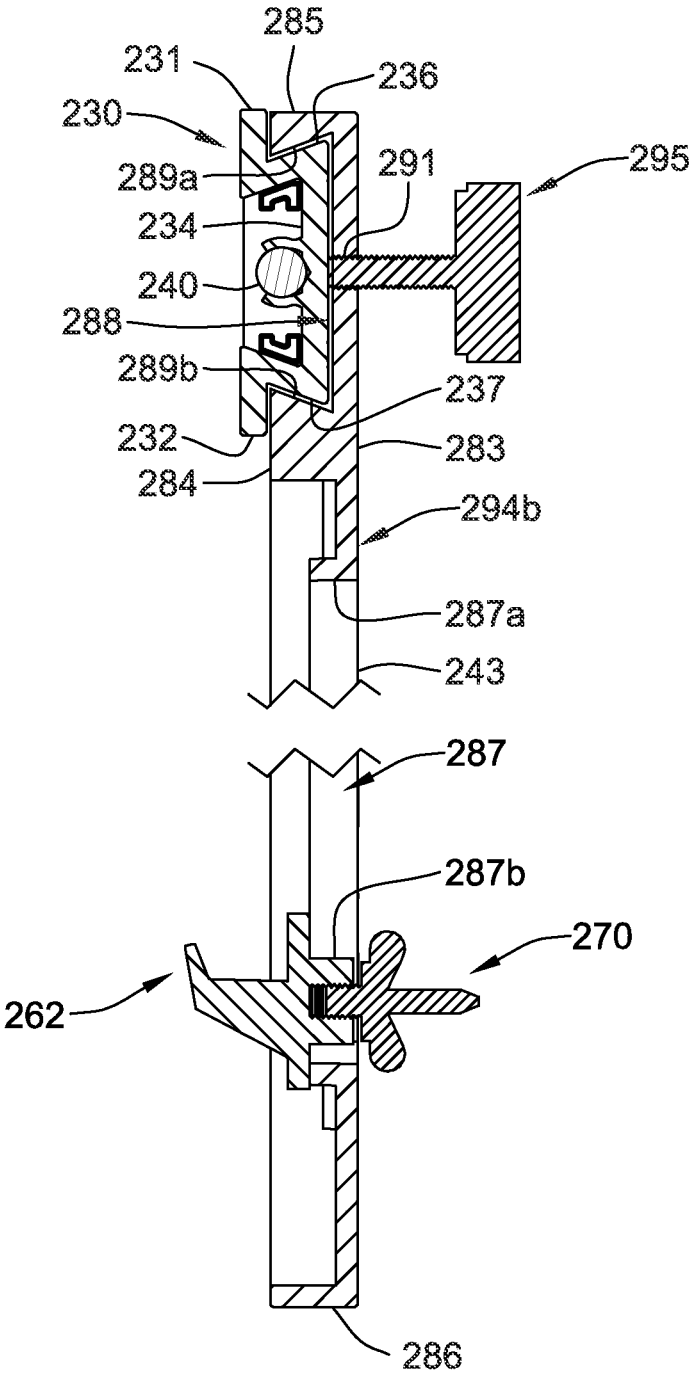
FIG. 18 is an enlarged partial cross-sectional view of the device of FIG. 15 taken through lines 18-18 thereof.
Figure 19:
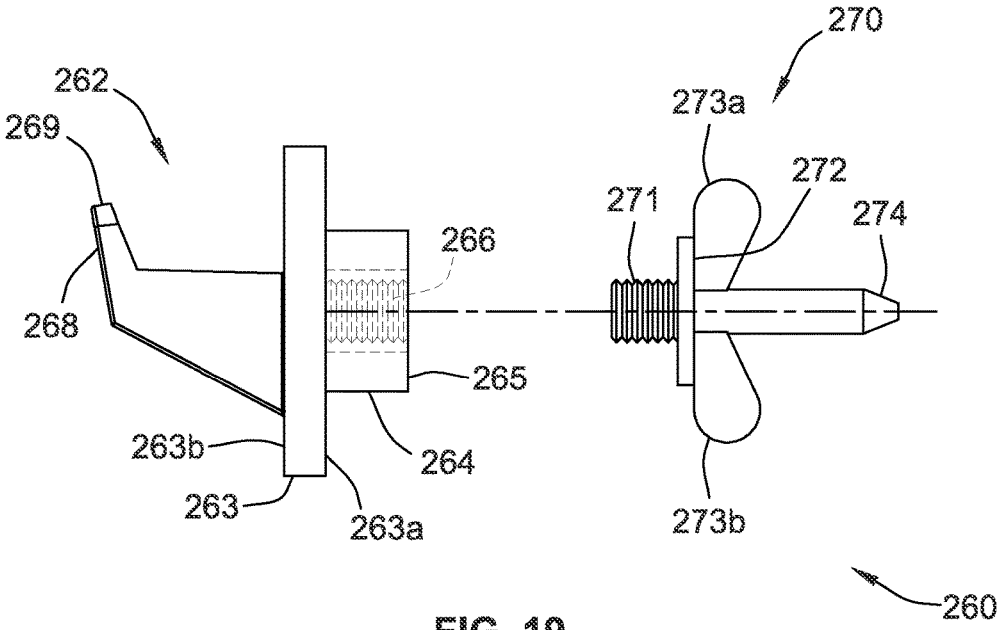
FIG. 19 is an enlarged exploded view of an adjustable marking member for the device shown in FIG. 15.

As best seen in FIG. 17, extending through the slot 245 of the fixed arm 294*a* is an adjustable marking member 260. Referring to FIG. 19, the adjustable marking member 260 includes a slide member 262 and a marking pin assembly 270. The slide member 262 has a centrally located generally cylindrical disc 263 with a forward surface 263*a* and a rearward surface 263*b*. Extending from the forward surface 263*a* of the disc 263 is a rectangularly shaped guide portion 264 having opposing parallel sides that are spaced apart a distance that is a little less than the distance between the sides of the slot 245 such that the rectangular portion 264 can be slideably received in the slot 245 of the fixed arm 294*a*. The forward end 265 of the guide portion 264 is planar. A threaded bore 266 extends between the forward end 265 and the forward surface 263*a* of the cylindrical disc 263. The slide member 262 further includes hook 268 that extends from the rearward surface 263*b* of the cylindrical disc 263. The hook 268 has a hook end 269 that is the same as, or similar to, the hook end 124 described herein.

The marking pin assembly 270 includes a threaded shank 271, a disc 272, and a pair of opposing thumb handles 273*a,b* on the forward surface thereof. Centrally located between the thumb handles 273*a,b* and extending outward of the disc 272 is a marking pin 274. As shown in FIG. 17, the marking pin assembly 270 is operatively coupled to the fixed arm 294*a*. Specifically, the marking pin assembly 270 is coupled to the slide member 262 in a threadingly manner.

When the rectangular guide portion 264 is fitted into the slot 245 of the fixed arm 294*a* with the hook 268 extending from the rearward surface 244 (FIG. 16) of the fixed arm 294*a*, the slide member 262 is retained in place by the discs 263 and 272 which are compressed against the forward and rearward surfaces 243, 244 of the fixed arm 294*a* when the threaded shank 271 is received in the complementarily threaded bore 266.

In some implementations, when the adjustable marking member 260 is loosely retained together (e.g., marking pin assembly 270 is not fully tightened into the slide member 262), the marking member 260 is slideable along the slot 245. However, for example, when the thumb handles 273*a,b* are used to fully tighten the shank 271 into the bore 266, the location of the marking member 260 along the slot 245 is fixed.

Referring generally to FIGS. 15 and 16, the adjustable arm 294*b* has parallel opposing linear sides 281, 282, a forward surface 283 (FIGS. 15 and 18), a rearward surface 284 (FIG. 16), and upper and lower ends 285, 286 (FIG. 18). An elongated slot 287 (FIG. 15) is positioned through the forward surface 283 and the rearward surface 284. The slot 287 has parallel sides that extend parallel to the side edges 281, 282. The slot 287 has an upper end 287*a* and a lower end 287*b*. For simplicity of manufacturing the device 200, it is desirable that the slot edges of the slot 287 are spaced apart a distance equal to the spacing of the sides of the slot 245.

As best shown in FIG. 18, near the upper end 285 of the adjustable arm 294*b*, the rearward surface 284 of the adjustable arm 294*b* has an indentation 288. The indentation 288 has two opposing sloped surfaces 289*a,b* that converge toward each other. The spacing between the sloped surfaces 289*a,b* is slightly larger than the spacing between the angled surfaces 236 and 237 of the crossbar 230 that form the track in the crossbar 230 such that the adjustable arm 294*b* is slidable along the crossbar 230. When the adjustable arm 294*b* is coupled to the crossbar 230 in a slidable manner, the adjustable arm 294*b* is generally perpendicular to the upper and lower edges 231, 232 of the crossbar 230.

As best shown in FIG. 18, a knob screw 295 is threadingly received in a threaded bore 291 in the forward surface 283 of the adjustable arm 294*b* that intersects the indentation 288 such that tightening the knob screw 295 locks the adjustable arm 294*b* at a fixed location along the length of the crossbar 230.

In some implementations of the present disclosure, the slot 287 is the same in dimensions as the slot 245. In such implementations, a marking member 260 that is the same as the marking member 260 described in reference to the fixed arm 294*a* is inserted into slot 287 with the marking pin 274 and the hook 268 oriented in the same directions as marking pin 274 and the hook 268 of the marking member 260 coupled to the fixed arm 294*a*.

With the device 200 assembled as shown FIGS. 15 and 16, the adjustable arm 294*b* can be linearly moved along the crossbar 230 until the hooks 268 of the two marking members 260 are spaced the distance 25 between the loops 20, 21 (FIG. 1) of the object 10 to be hung on a wall. The adjustable arm 294*b* can be locked in place with the knob screw 295 (FIG. 18) after which the marking members 260 can be moved vertically until the hooks 268 thereof engage the loops 20, 21 of the object 10. Thereafter the marking members 260 can be locked in place by using the thumb handles 273*a,b* to tighten the shank 271 into the bore 266 of each of the slide members 262. With the marking pin assemblies 270 tightened to the slide members 262, the device 200 can be placed against the wall in a level orientation using the level bubble 240 after which the marking pins 274 of the marking members 260 can be used to mark the wall for receiving respective mounting hooks (e.g., nail, picture hook, etc.).

While the device 200 is depicted as having a crossbar 230 from which extends the fixed arm 294*a* and the adjustable arm 294*b*, it should be apparent that the fixed arm 294*a* could be eliminated from the device 200 and a second adjustable arm, such as arm 294*b* substituted in its place. It should also be apparent that a device (e.g., device 28, 200) can be made with one adjustable arm, such as arm 294*b*, a knuckle, such as knuckle 42, and an arm, such as arm 94 slideably received in the knuckle 42. Accordingly, there are numerous modifications and variations for the crossbars, arms, and knuckles of the present disclosure.

The knuckles 42 of the present disclosure can be made of a variety of materials, such as, for example, plastic, metal, or any combination thereof. The knuckles can be opaque, transparent, or a combination thereof. In some implementations, at least a portion of one or both of the shoulders 82, 84 of the knuckles 42 can be made of a transparent material to aid in viewing the dimensional markings 33 printed on the forward surface 32 of the crossbar 30. Alternatively, a notch (not shown) can be formed in one or both of the shoulders 82, 84 of the knuckles 42 to aid in viewing the dimensional markings 33 printed on the forward surface 32 of the crossbar 30. Further, while the knuckles 42 of the present disclosure are shown and described as having shoulders 82, 84, in some alternative implementations, the shoulders 82, 84 are removed from the knuckles 42 (e.g., the knuckles 42 do not have shoulders 82, 84).

Figure 20:
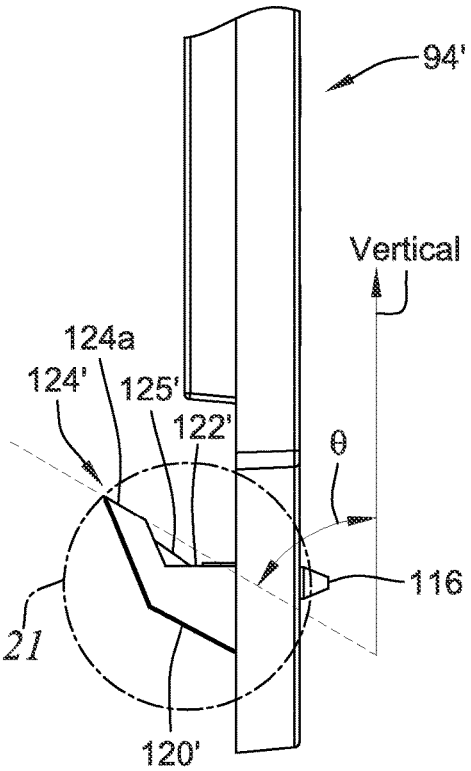
FIG. 20 is an enlarged partial side view of an arm having a hook with a ramped surface according to some implementations of the present disclosure.

The hooks 120, 268 of the present disclosure are best shown in FIGS. 11 and 19 and are described above. However, various alternative geometries for the hooks 120, 268 are possible. For example, as shown in FIG. 20, a lower portion of an alternative arm 94' is shown as including a hook 120'. A hook end 124' of the hook 120' is slanted (e.g., angled) to form a ramp surface 124*a*. The ramp surface 124*a* can be used to aid in capturing the loops 20, 21 of the object 10 on a retaining surface 122' of the hook 120'. For example, the ramp surface 124*a* can be used to slide under and lift the loops 20, 21, even when the loops 20, 21 are resting against the rearward surface 18 of the object (FIG. 1). The angle, θ, of the ramp surface 124*a* with respect to vertical, can be, for example, between five and eighty-five degrees. More preferably, the angle, θ, of the ramp surface 124*a* with respect to vertical is between thirty and sixty degrees. In some implementations, the angle, θ, of the ramp surface 124*a* with respect to vertical is about forty-five degrees (e.g., forty to fifty degrees).

Figure 21:
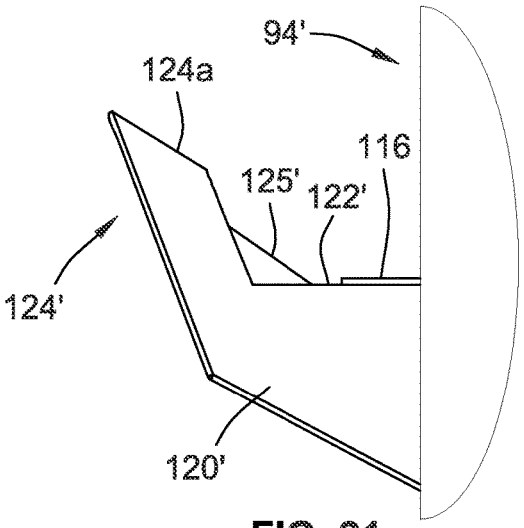
FIG. 21 is an enlarged view of a portion of FIG. 20.

Further, as best shown in FIG. 21, the hooks 120' can include a webbing 125' positioned between the hook end 124' and the retaining surface 122' of the hook 120'. The webbing 125' can aid in strengthening the hooks 120' by adding rigidity to the hook end 124'. Further, the webbing 125' can aid in prolonging the life of the hooks 120' by reducing the possibility that the hook 120' will fail by, for example, the hook end 124' breaking off during use of the device 28, 200. The webbing 125' can extend across the entire thickness (measured into the page of FIG. 21) of the hook 120' or a portion thereof (e.g., the webbing 125' can extend across fifty percent of the thickness of the hook 120'). While the webbing 125' is shown as having a generally triangular cross-section, the webbing 125' can have any cross-sectional shape (e.g., square, rectangular, polygonal, etc.). In some implementations, a surface of the webbing 125' forms a ramp surface having the same, or similar, angle with respect to vertical as the ramp surface 124*a*.

As shown in FIG. 21, an uppermost surface of the marking pin 116 rests slightly (e.g., 0.1 inches, 10 mils, etc.) above the retaining surface 122'. Alternatively, the marking pin 116 can be positioned to rest slightly below the retaining surface 122' (not shown) or at the same level (e.g., same plane) as the retaining surface 122'.

Figures 22A, 22B, 22C:
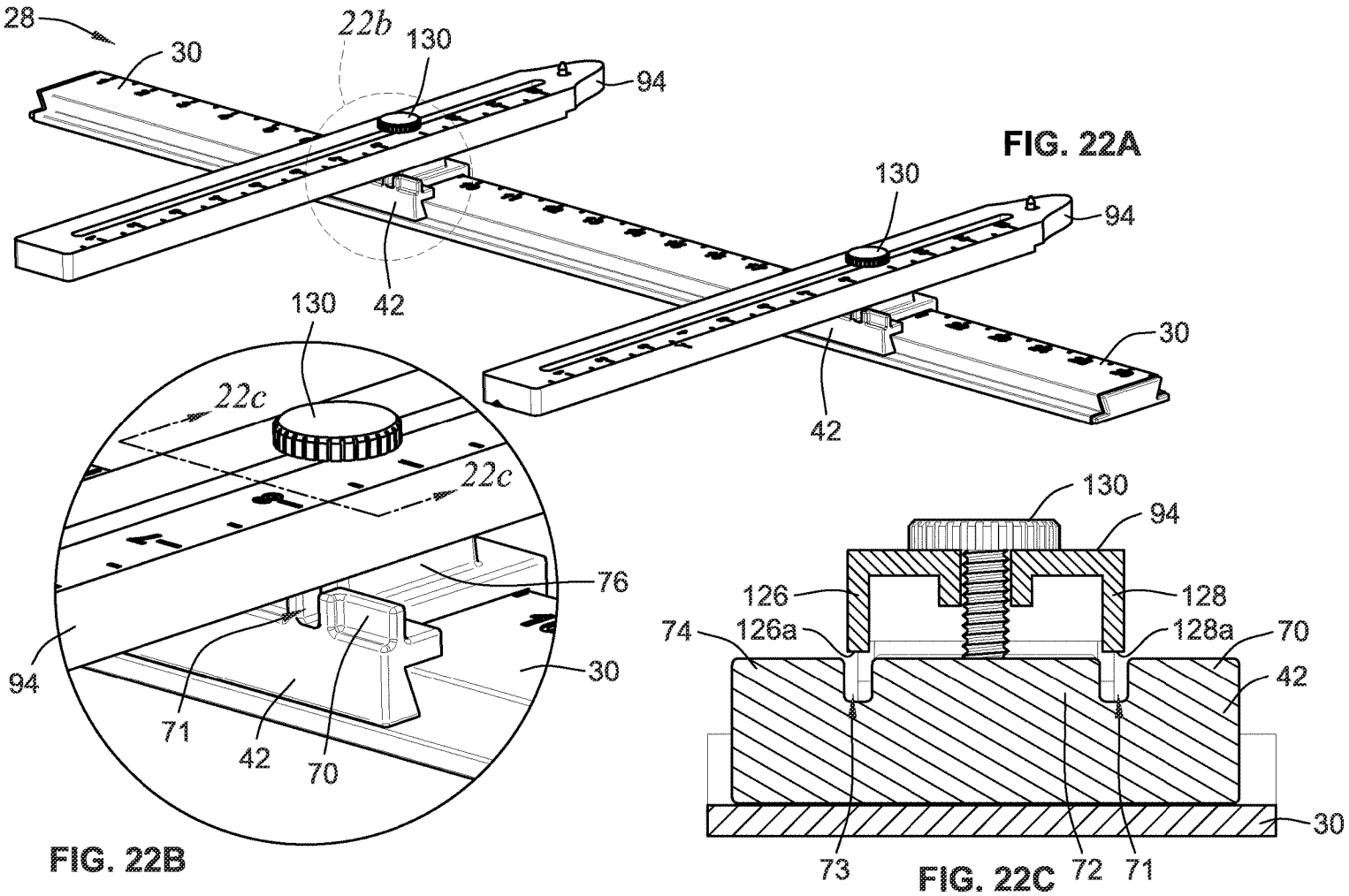
FIGS. 22A-22C are various views of a device in its assembled configuration according to some implementations of the present disclosure.

Generally referring to FIGS. 22A-24C, a method of converting the device 28 (e.g., a two arm 94 implementation) from its assembled configuration (FIG. 22A) to its storage configuration (FIG. 24A) is shown and described. As shown in FIGS. 22A-22C, the device 28 is in its assembled configuration, where both arms 94 are substantially perpendicular to the crossbar 30 and the device 28 is ready for using to hang objects.

To convert the device 28 from its assembled configuration (FIG. 22A) to its storage configuration (FIG. 24A), as best shown in FIGS. 22B and 22C, the knob screws 130 are sufficiently loosened such that the arms 94 can be unseated from the knuckles 42. As shown in FIG. 22C, the knob screws 130 are unscrewed such that the projections 126, 128 of the arms 94 can be lifted out of the gaps 71, 73 in the knuckles 42 and such that the distal ends 126*a*, 128*a* of the projections 126, 128 are slightly higher than the uppermost surfaces of the projections 70, 72, 74, and 76.

Figure 23A:
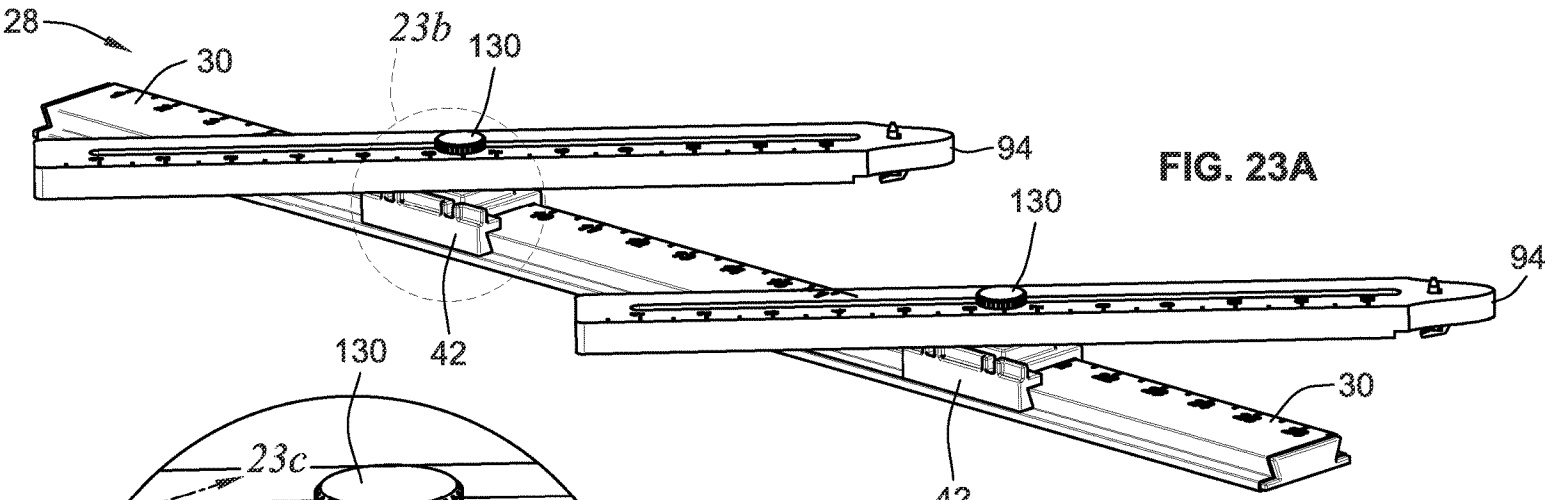
FIGS. 23A-23C are various views of the device of FIGS. 22A-22C in an intermediate configuration.
Figure 23C:
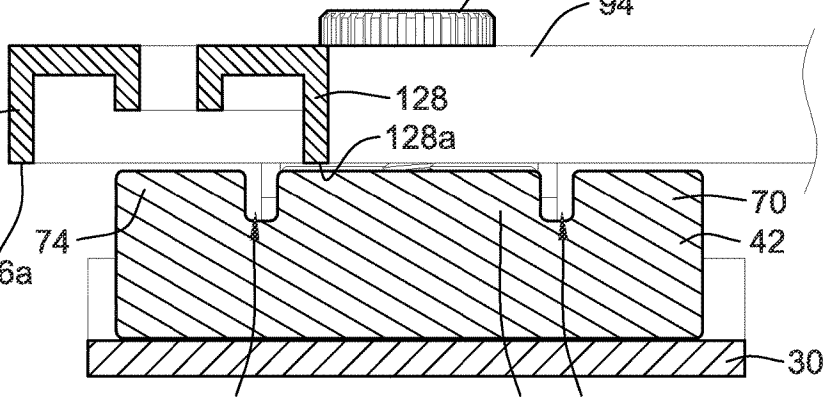
Figure 23B:
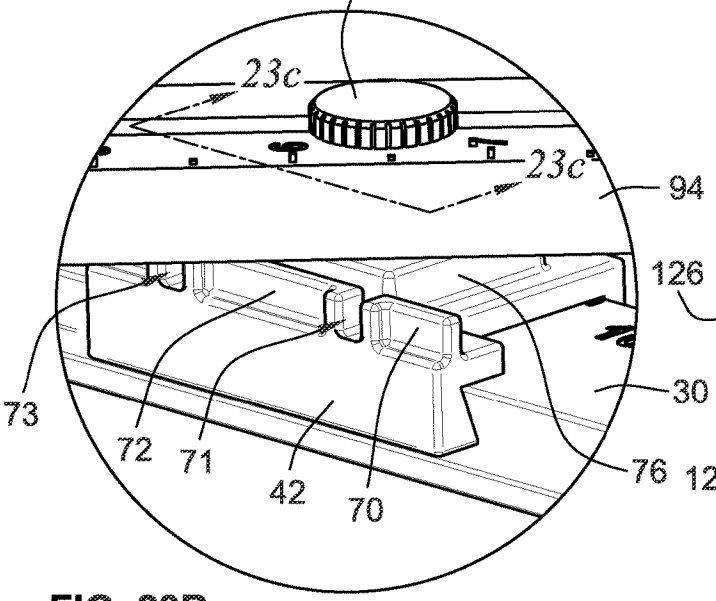
Figure 24A:
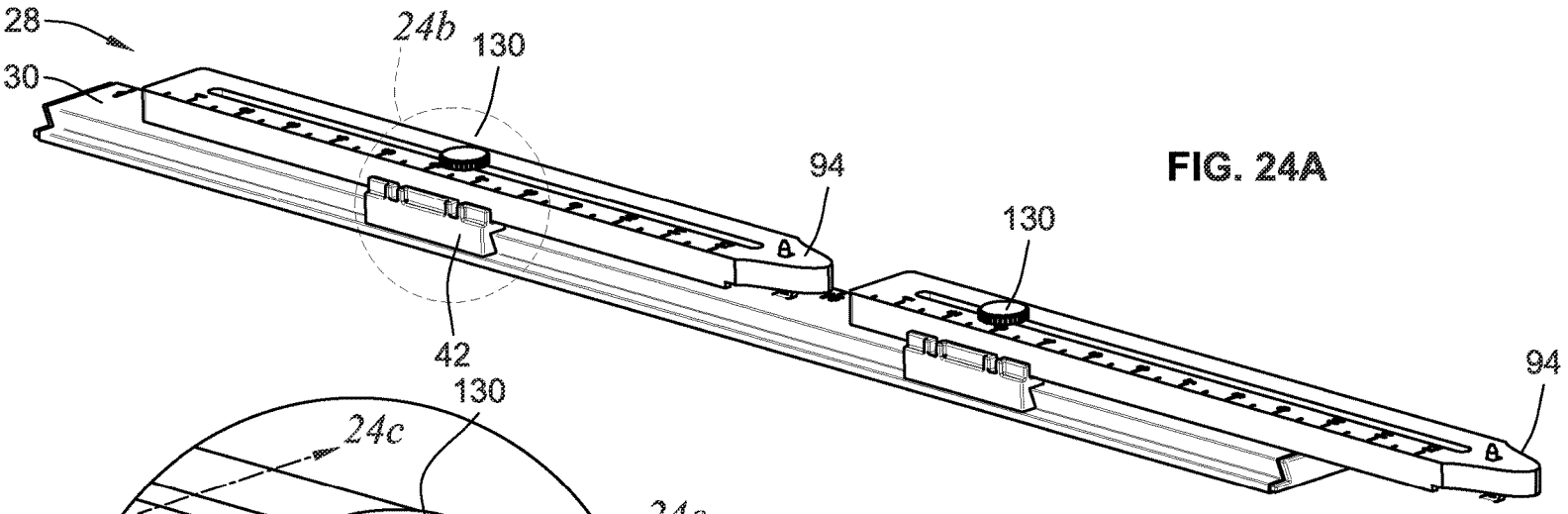
FIGS. 24A-24C are various views of the device of FIGS. 22A-22C in its storage configuration.
Figure 24B:
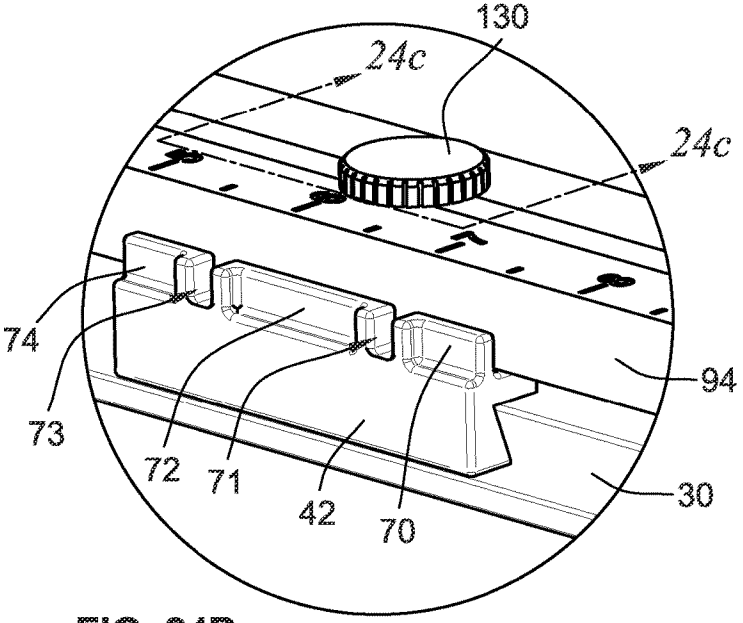
Figure 24C:
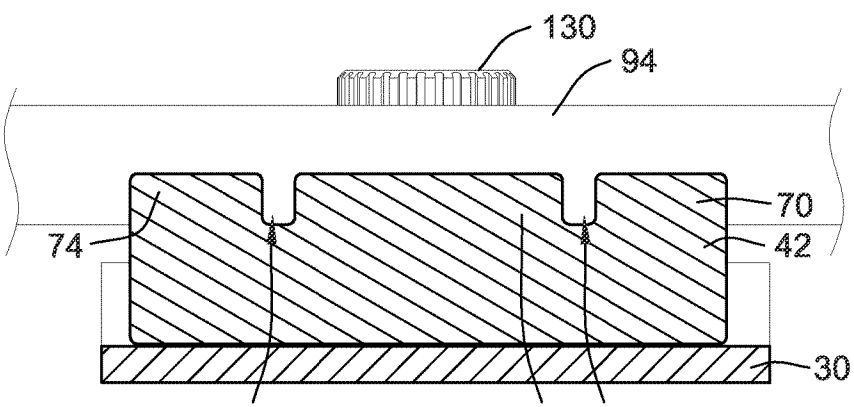

The arms 94 are then rotated about the knob screws 130 above the knuckles 42 such that the arms 94 are parallel with the crossbar 30. FIGS. 23A-23C illustrate an intermediate rotational position of the arms 94 with respect to the crossbar 30. FIGS. 24A-24C illustrate the arms 94 in the storage position of the device 28. Specifically, in the storage position of the device 28, the arms 94 have been rotated about ninety degrees, such that the arms 94 are substantially parallel with the crossbar 30. Further, the arms 94 are rested on the knuckles 42 such that distal ends 126*a*, 128*a* of the projections 126, 128 rest on the forward surface 58 of the knuckle and such that the projections 126, 128 of the arms 94 abut the second pair of parallel sides 79, 81 of the fourth projection 76. As each of the arms 94 is slideably received about the fourth projection 76 of the knuckle 42, the arms 94 can be linearly moved (e.g., slid) along the length of the crossbar 30 to equally space the arms 94 thereabout and then the knob screws 130 can be tightened to hold device 28 in the storage configuration (FIG. 24A).

As described above, the device 28 includes two end caps 41, 43 (FIG. 4) that can be coupled to opposing ends of the crossbar 30 for aesthetically covering the ends thereof. In lieu of the end caps 41, 43, end caps 341, shown in FIG. 25, can be coupled to the ends of the crossbar 30. In addition to aesthetically covering the ends of the crossbar 30, each of the end caps 341 can be used to aid a user of the device 28 to position an object (e.g., object 10) at a predetermined relative position and/or orientation with respect to another object (e.g., object 10). For example, the end caps 341 can be used to aid a user of the device 28 in hanging the object 10 on the wall (not shown) such that the upper edge 12 of the object 10 is co-linear with an upper edge of an adjacent object (not shown).

Figure 25:
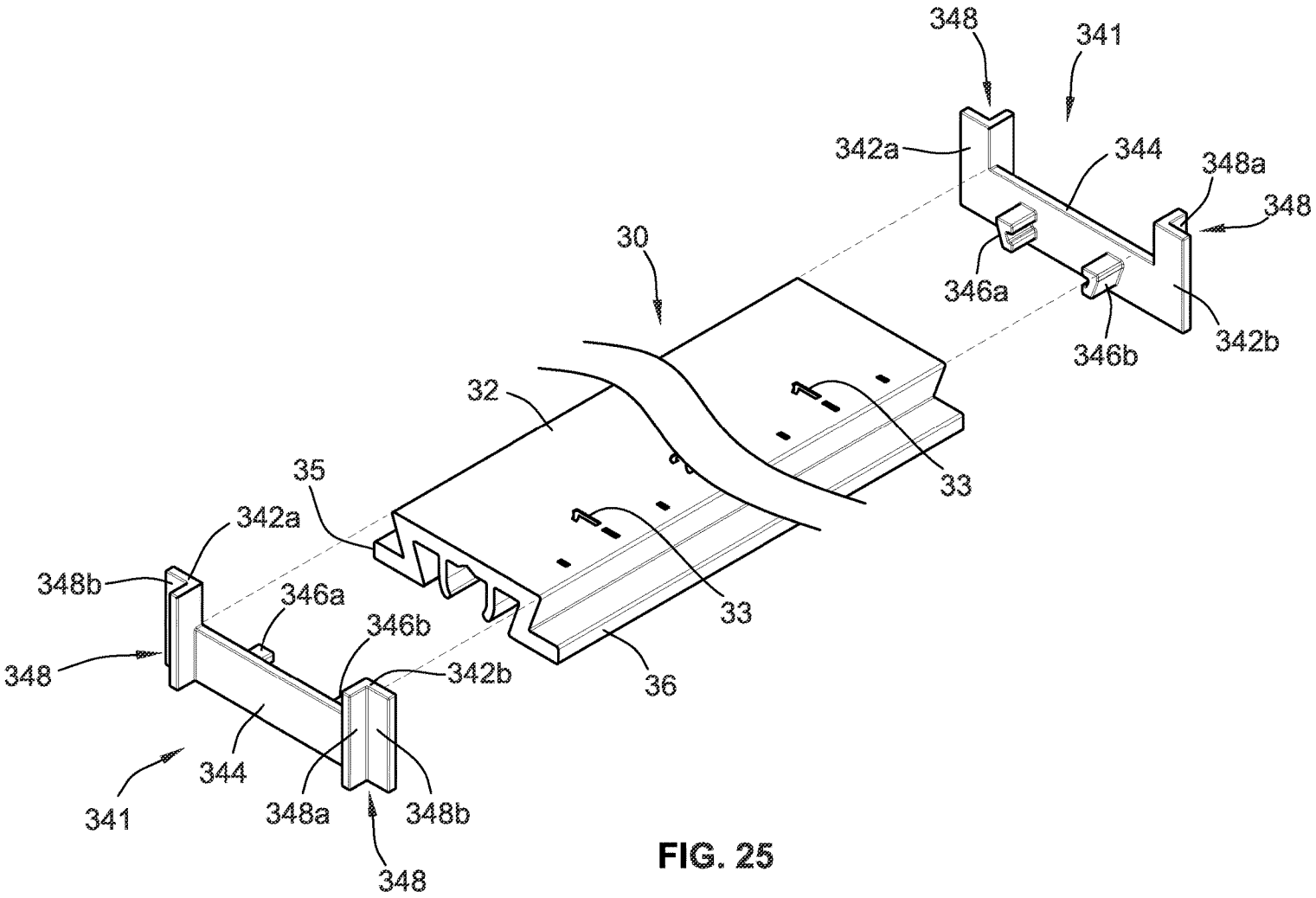
FIG. 25 is a partial perspective exploded view of a crossbar of the device of FIG. 2 including end caps according to some implementations of the present disclosure.

As shown in FIG. 25, each of the end caps 341 includes an upper "L" bracket 342*a* and a lower "L" bracket 342*b* attached by a cross-bracket 344. The cross-bracket 344 includes two protrusions 346*a,b* that fit into the ends of the crossbar 30 to removably couple the end caps 341 with the crossbar 30. Each of the "L" brackets 342*a,b* provides an engagement surface 348 for engaging and/or abutting, for example, a corner of an adjacent object. Each of the engagement surfaces 348 includes a horizontal engagement portion 348*a* and a vertical engagement portion 348*b*. In some implementations, the horizontal engagement portion 348*a* of the engagement surface 348 of the upper "L" bracket 342*a* is coplanar with the upper edge 35 of the crossbar 30 when the end cap 341 is attached to the crossbar 30. Similarly, in some implementations, the horizontal engagement portion 348*a* of the engagement surface 348 of the lower "L" bracket 342*b* is coplanar with the lower edge 36 of the crossbar 30 when the end cap 341 is attached to the crossbar 30.

According to some implementations of the present disclosure, a user of the device 28 including one of the end caps 341 can hang an object at a predetermined linear horizontal distance from an adjacent object already hanging on a wall such that the upper edges of both objects are co-linear. For example, a user of the device 28 with two arms 94 and one of the end caps 341 attaches the device 28 to an object to be hung as described above. Further, the user slides both arms 94 (while attached to the object via the hooks 120) a desired distance from the end cap 341 (e.g., eight inches) and then locks both arms 94 in place using the knob screws 130. Alternatively, the user can hold the object and arms 94 in place and slide the crossbar 30 such that the desired distance is positioned between the vertical engagement portion 348*b* of the end cap 341 and the closest one of the arms 94. Then the device 28 is removed from the object to be hung and the engagement surface 348 of the end cap 341 is mated with the upper corner of the object already hung on the wall. The crossbar 30 is then leveled using the level bubble 48 and dimples are made in the wall using the marking pins 116 of the device 28. Hooks (not shown) are attached to the wall at the location of the dimples and the object is then hung thereon such that the upper edge of both objects on the wall are co-linear.

Figure 26:
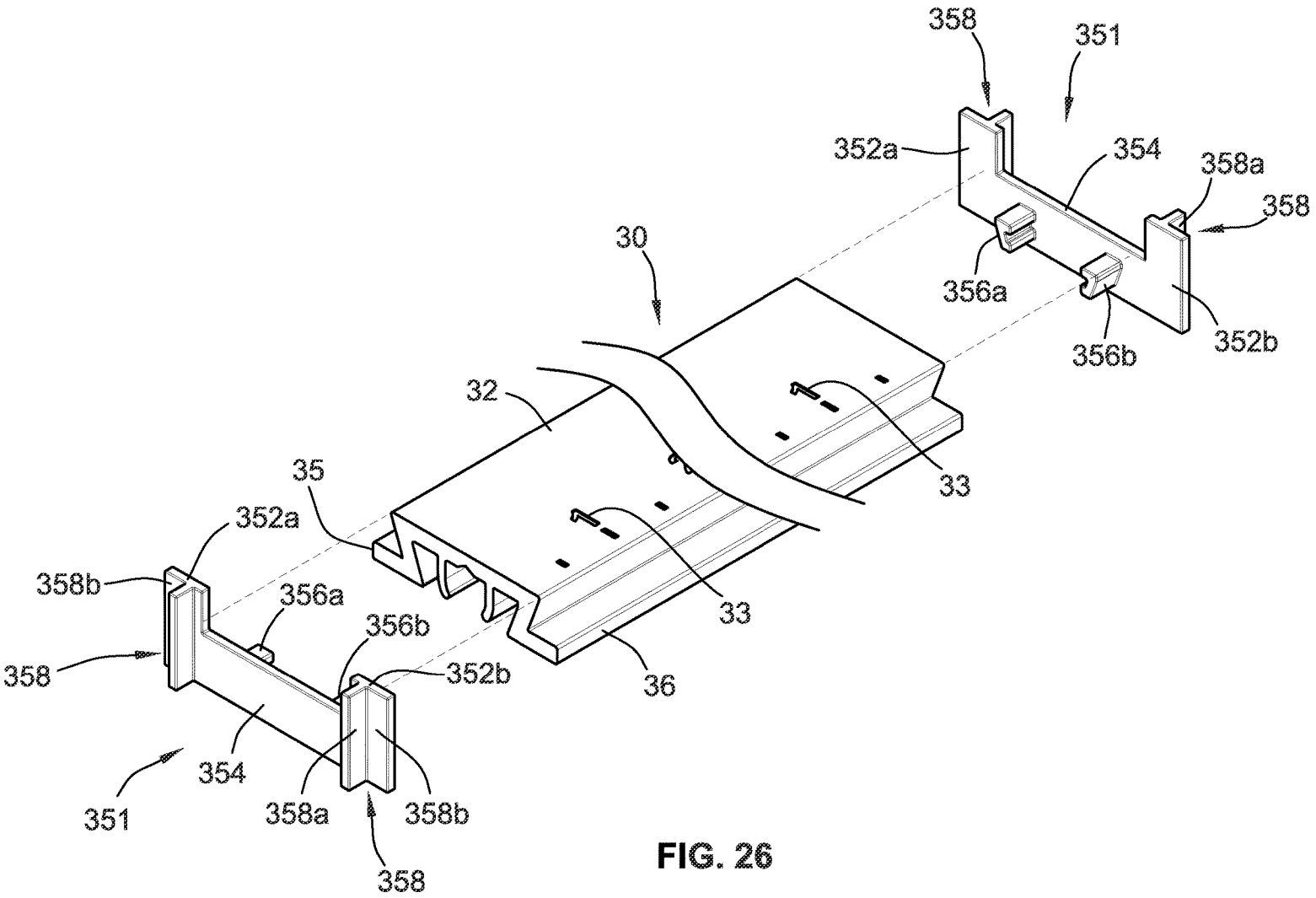
FIG. 26 is a partial perspective exploded view of a crossbar of the device of FIG. 2 including end caps according to some implementations of the present disclosure.

Referring to FIG. 26, end caps 351 can be coupled to the ends of the crossbar 30 to aid a user of the device 28 to position an object (e.g., object 10) at a predetermined relative position and/or orientation with respect to another object (e.g., object 10). For example, the end caps 351 can be used to aid a user of the device 28 in hanging the object 10 on the wall (not shown) such that the upper edge 12 of the object 10 is co-linear with an upper edge of an adjacent object (not shown).

As shown in FIG. 26, each of the end caps 351 includes an upper "T" bracket 352*a* and a lower "T" bracket 352*b* attached by a cross-bracket 354. The cross-bracket 354 includes two protrusions 356*a,b* that fit into the ends of the crossbar 30 to removably couple the end caps 351 with the crossbar 30. Each of the "T" brackets 352*a,b* provides an engagement surface 358 for engaging and/or abutting, for example, a corner of an adjacent object. Each of the engagement surfaces 358 includes a horizontal engagement portion 358*a* and a vertical engagement portion 358*b*. In some implementations, the horizontal engagement portion 358*a* of the engagement surface 358 of the upper "T" bracket 352*a* is coplanar with the upper edge 35 of the crossbar 30 when the end cap 351 is attached to the crossbar 30. Similarly, in some implementations, the horizontal engagement portion 358*a* of the engagement surface 358 of the lower "T" bracket 352*b* is coplanar with the lower edge 36 of the crossbar 30 when the end cap 351 is attached to the crossbar 30. The end caps 351 can be used in a similar fashion as the end caps 341 to hang objects at predetermined positions and/or orientations from previously hung objects.

The device 28 described above can be used to hang objects (e.g., object 10) in a stair stepping fashion. For example, in some instances it is desirable to hang a first object at a first location and to hang a second object at a second location such that an upper left corner of the second object is positioned a first horizontal distance from the right edge of the first object and a first vertical distance from the upper edge of the first object. In some implementations of the present disclosure, an arm cap 360 can be used in conjunction with the device 28 to hang objects in the stair stepping fashion.

Figure 27A:
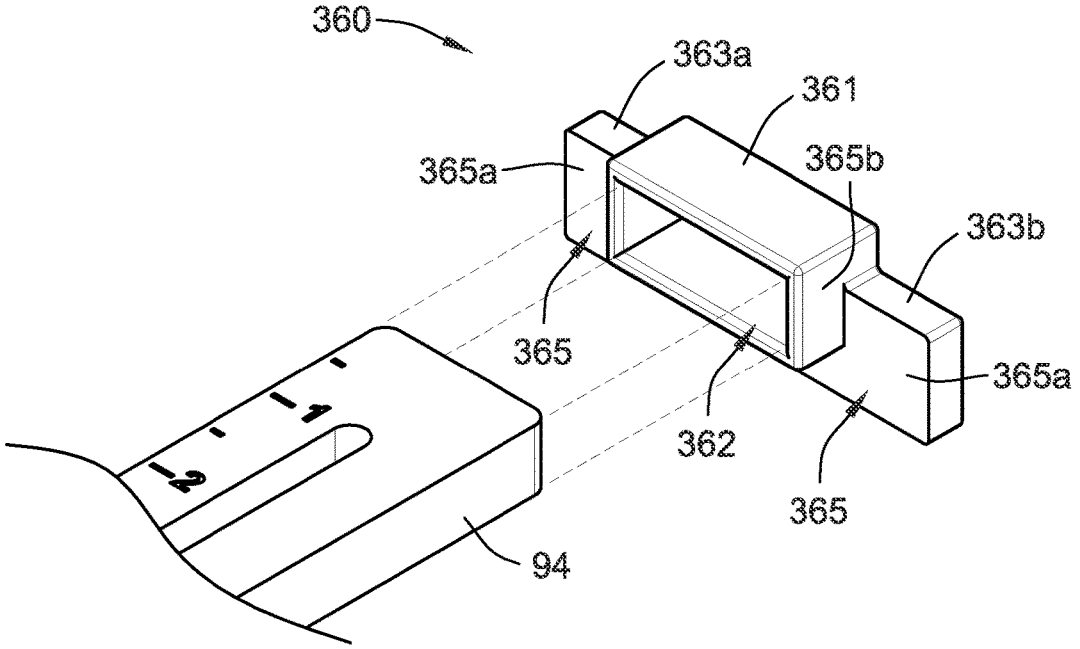
FIGS. 27A and 27B are a partial perspective exploded views of an arm of the device of FIG. 2 including an arm cap according to some implementations of the present disclosure.
Figure 27B:
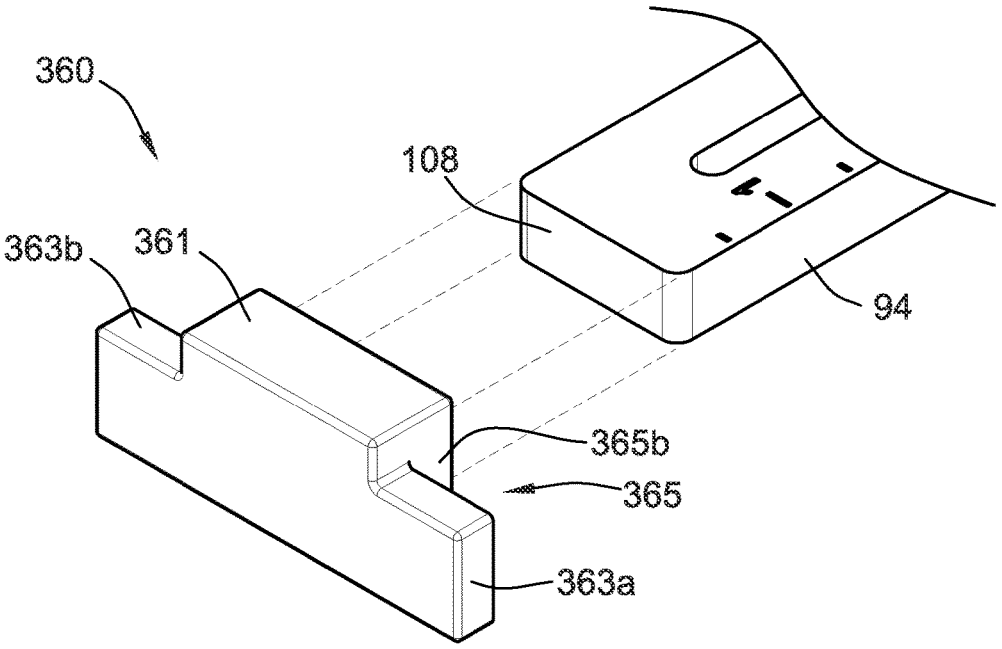

As shown in FIGS. 27A and 27B, the arm cap 360 is configured to slide onto the upper end 108 of the arm 94. The arm cap 360 includes a body 361, a cavity 362, and first and second shoulders 363*a,b* protruding from either side of the body 361. The cavity 362 is sized and shaped to fit onto (e.g., press-fit, snap fit, etc.) the upper end 108 of the arm 94. The body 361 and the shoulders 363*a,b* provide engagement surfaces 365 for engaging and/or abutting, for example, a corner of an adjacent object. Each of the engagement surfaces 365 includes a horizontal engagement portion 365*a* and a vertical engagement portion 365*b*. In some implementations, the horizontal engagement portion 365*a* of the engagement surface 365 of the arm cap 360 is coplanar with the upper end 108 of the arm 94 when the arm cap 360 is attached to the arm 94.

According to some implementations of the present disclosure, a user of the device 28 including three arms 94 and the arm cap 360 on a first one of the arms 94 can hang an object at predetermined linear horizontal and vertical distances from an adjacent object already hanging on a wall such that the objects are hung in a stair stepping fashion. For example, a user of the device 28 with three arms 94 and the arm cap 360 slides the arm 94 with the arm cap 360 vertically to position the horizontal engagement portion 365*a* of the engagement surface 365 a desired distance from the lower edge 36 of the crossbar 30 and then locks the arm 94 in place by tightening the knob screw 130 associated therewith. In some implementations, the arm 94 with the arm cap 360 is also positioned at one end of the crossbar 30. Then, the user attaches two other arms 94 of the device 28 to an object to be hung as described above. Further, the user slides the two other arms 94 (while attached to the object via the hooks 120) a desired distance from the arm 94 with the arm cap 360 (e.g., eight inches) and then locks both of the other arms 94 in place using the associated knob screws 130. Alternatively, the user can hold the object and two other arms 94 in place and slide the crossbar 30 and arm 94 with the arm cap 360 locked thereon such that the desired distance is positioned between the vertical engagement portion 365*b* of the arm cap 360 and the closest one of the two other arms 94. Then the device 28 is removed from the object to be hung and the engagement surface 365 of the arm cap 360 is mated with the upper corner of the object already hung on the wall. The crossbar 30 is then leveled using the level bubble 48 and dimples are made in the wall using the marking pins 116 of the two other arms 94 of the device 28. Hooks (not shown) are attached to the wall at the location of the dimples and the object is then hung thereon such that the objects are hung in a stair stepping fashion.

Figure 28A:
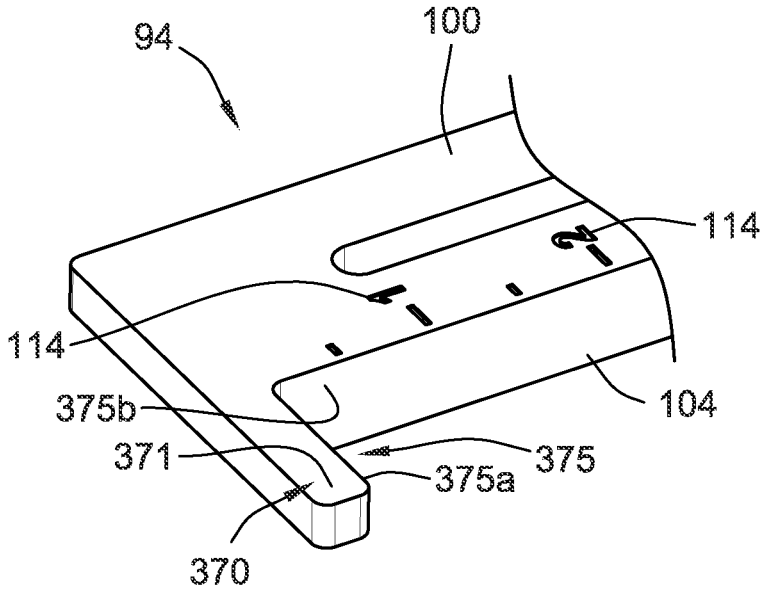
FIGS. 28A and 28B are a partial perspective exploded views of an arm including an integral ledge member according to some implementations of the present disclosure.
Figure 28B:
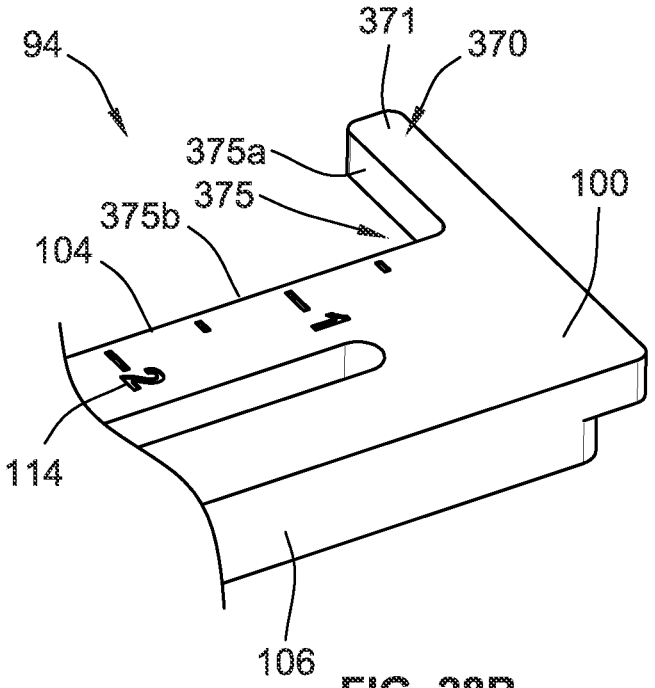

Referring to FIGS. 28A and 28B, alternatively or in addition to attaching a removable arm cap 360 to the arms 94 to aid in performing stair stepping-type hanging of objects, one or more of the arms 94 of the device 28 can include an integral ledge member 370 for use in hanging objects (e.g., object 10) in a stair stepping fashion. The integral ledge member 370 can protrude from one or both of the sides 104, 106 of the arm 94. As shown in FIGS. 28A and 28B, the integral ledge member 370 protrudes from the left side 104 of the arm 94. Further, a forward surface 371 of the integral ledge member 370 is coplanar with the forward surface 100 of the arm 94.

The integral ledge member 370 and the side 104 (e.g., left side) of the arm 94 provide an engagement surface 375 for engaging and/or abutting, for example, a corner of an adjacent object. The engagement surface 375 includes a horizontal engagement portion 375*a* and a vertical engagement portion 375*b* (e.g., the vertical engagement portion 375*b* is the side 104 of the arm 94). In some implementations, the horizontal engagement portion 375*a* of the engagement surface 375 of the integral ledge member 370 is positioned to be the zero point or origin of the dimensional markings 114 on the arm 94. The integral ledge member 370 can be used in a similar fashion as the arm cap 360 to hang objects in a stair stepping fashion with respect to previously hung objects.

Figure 29A:
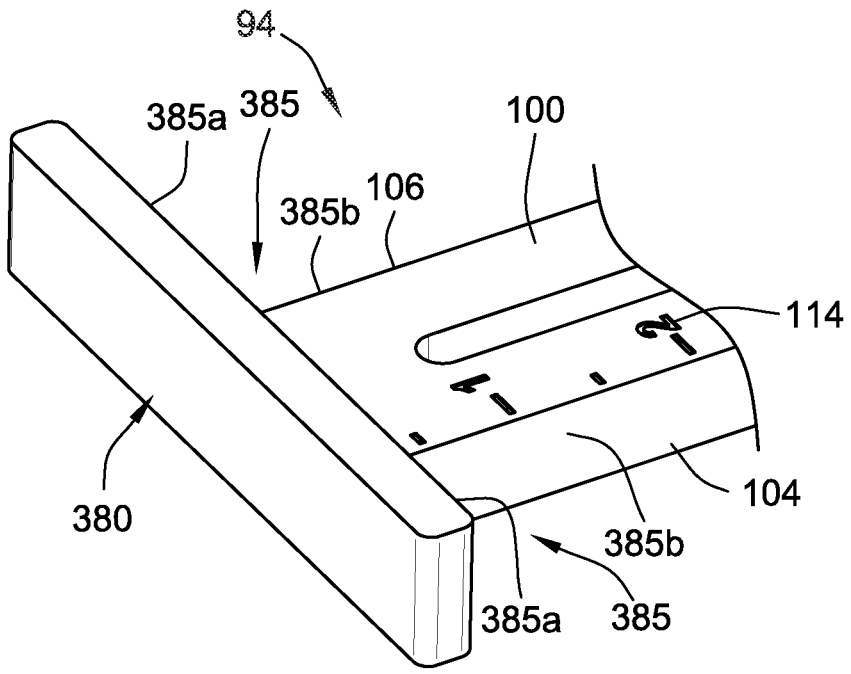
FIGS. 29A and 29B are a partial perspective exploded views of an arm including an integral dual-ledge member according to some implementations of the present disclosure.
Figure 29B:
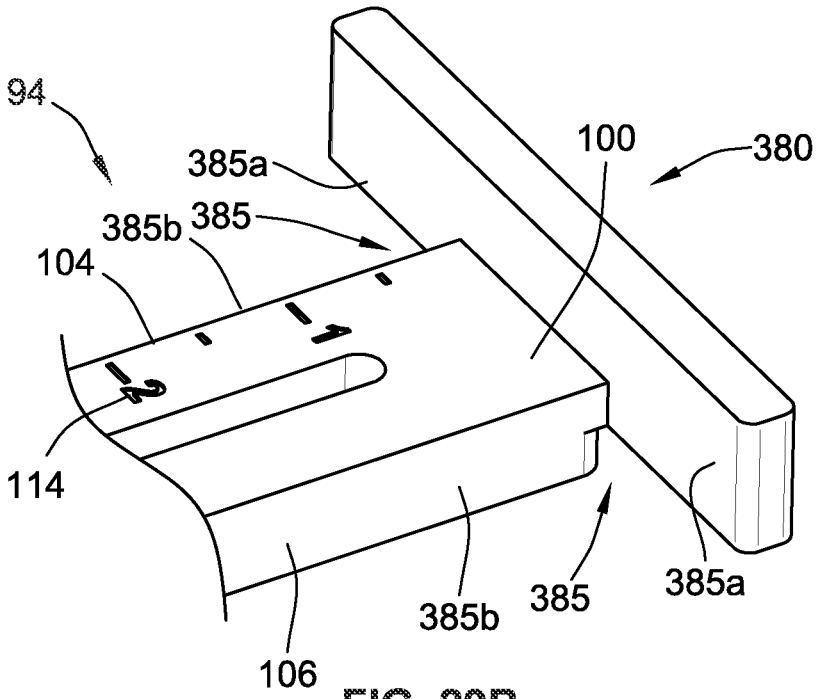

Referring to FIGS. 29A and 29B, alternatively to one or more of the arms 94 of the device 28 including the integral ledge member 370 (FIGS. 28A and 28B), one or more of the arms can include an integral dual-ledge member 380 for use in hanging objects (e.g., object 10) in a stair stepping fashion. The integral dual-ledge member 380 is similar to the integral ledge member 370 described above; however, the integral dual-ledge member 380 protrudes from both of the sides 104, 106 of the arm 94 and further protrudes from the forward surface 100 of the arm (e.g., the integral dual-ledge member 380 is not coplanar with the forward surface 100 of the arm 94).

The integral dual-ledge member 380 and the sides 104, 106 (e.g., left and right sides) of the arm 94 provide engagement surfaces 385 for engaging and/or abutting, for example, a corner of an adjacent object. Each of the engagement surfaces 385 includes a horizontal engagement portion 385*a* and a vertical engagement portion 385*b* (e.g., the vertical engagement portions 375*b* are the sides 104, 106 of the arm 94). In some implementations, the horizontal engagement portions 385*a* of the engagement surfaces 385 of the integral dual-ledge member 380 are positioned to be the zero point or origin of the dimensional markings 114 on the arm 94. The integral dual-ledge member 380 can be used in a similar fashion as the arm cap 360 and/or the integral ledge portion 370 to hang objects in a stair stepping fashion with respect to previously hung objects.

Figure 30A:
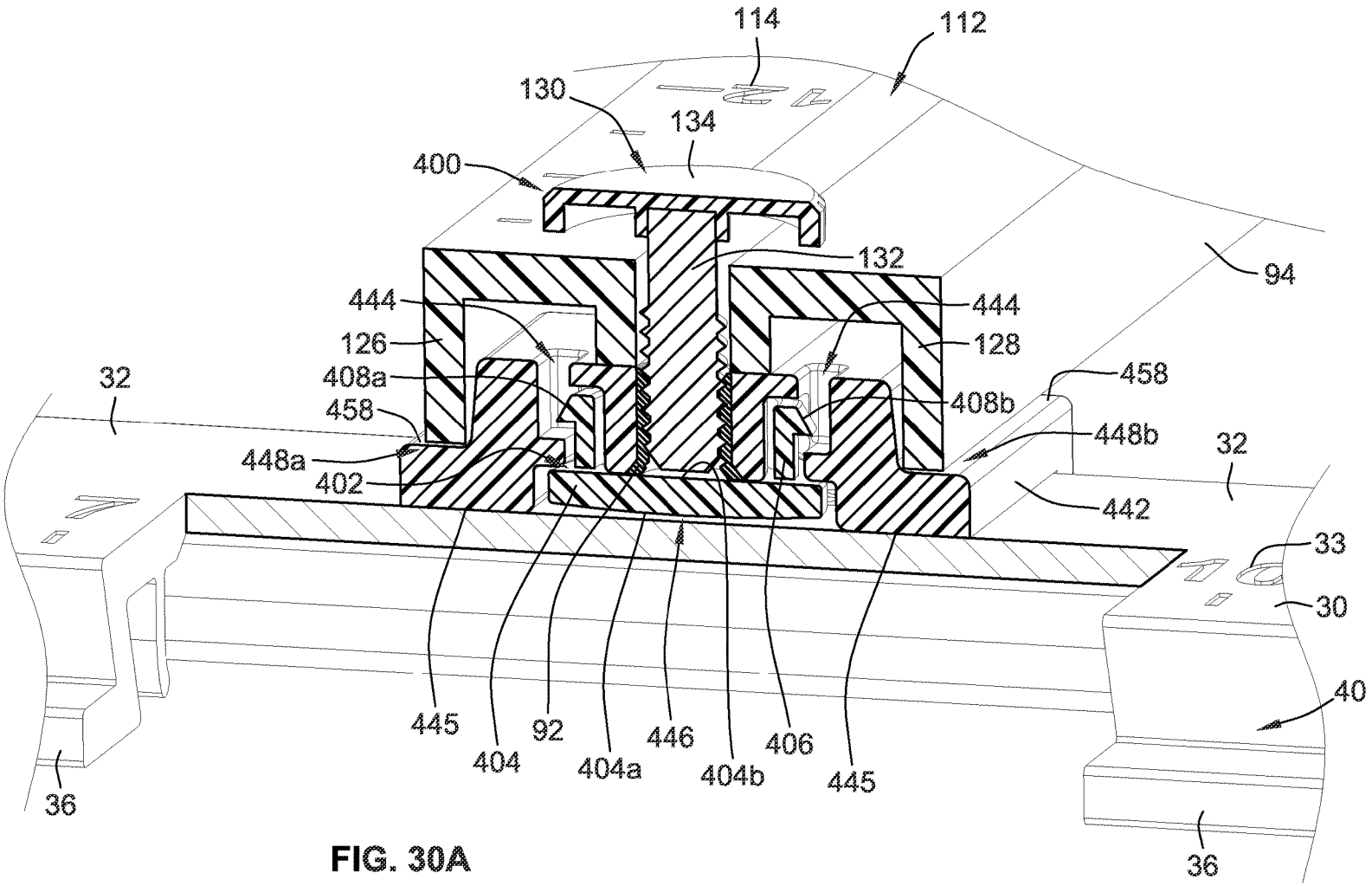
FIGS. 30A-30C are partial cross-sectional views of a device including a fastener assembly according to some implementations of the present disclosure.
Figure 30B:
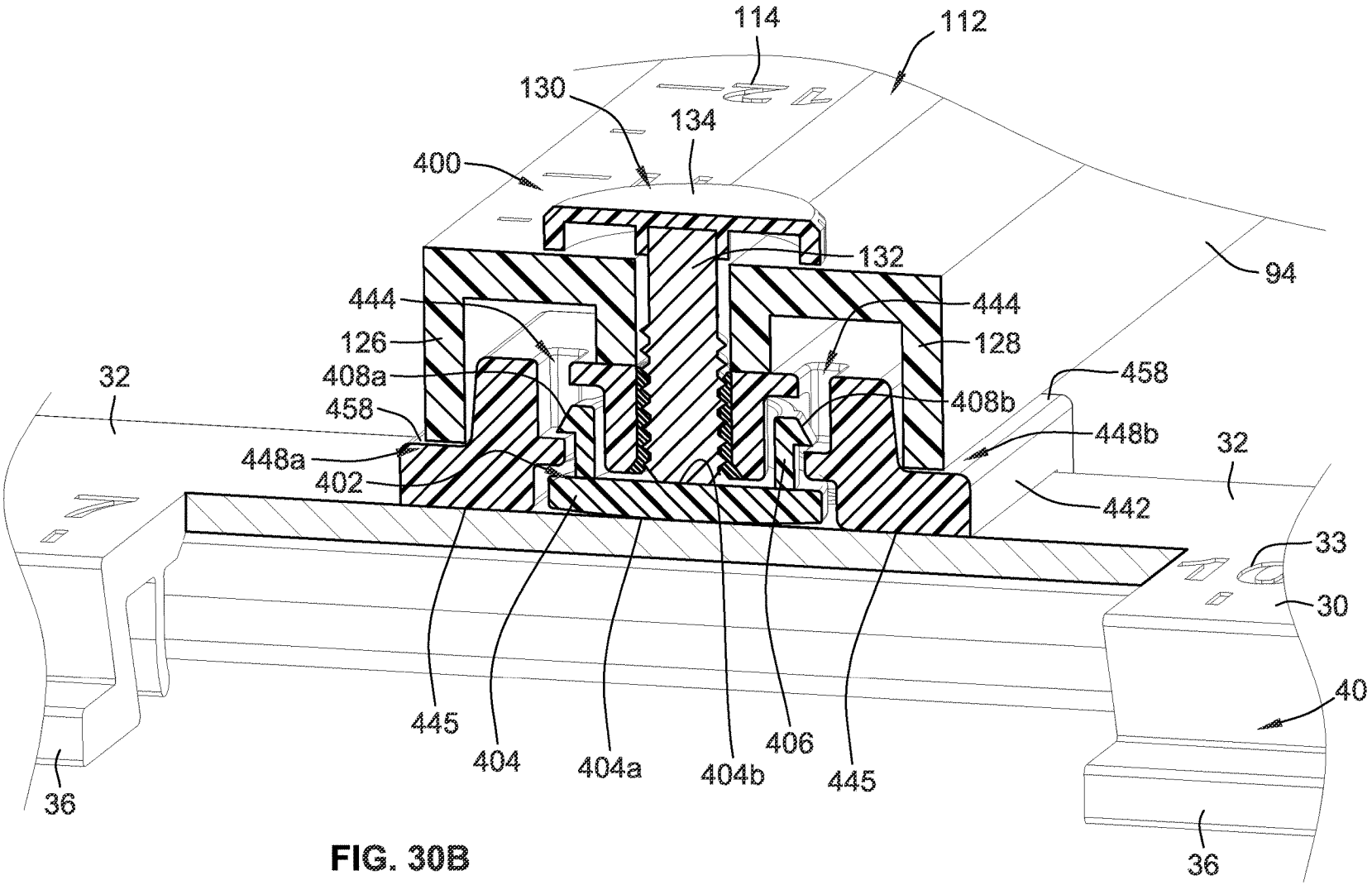
Figure 30C:
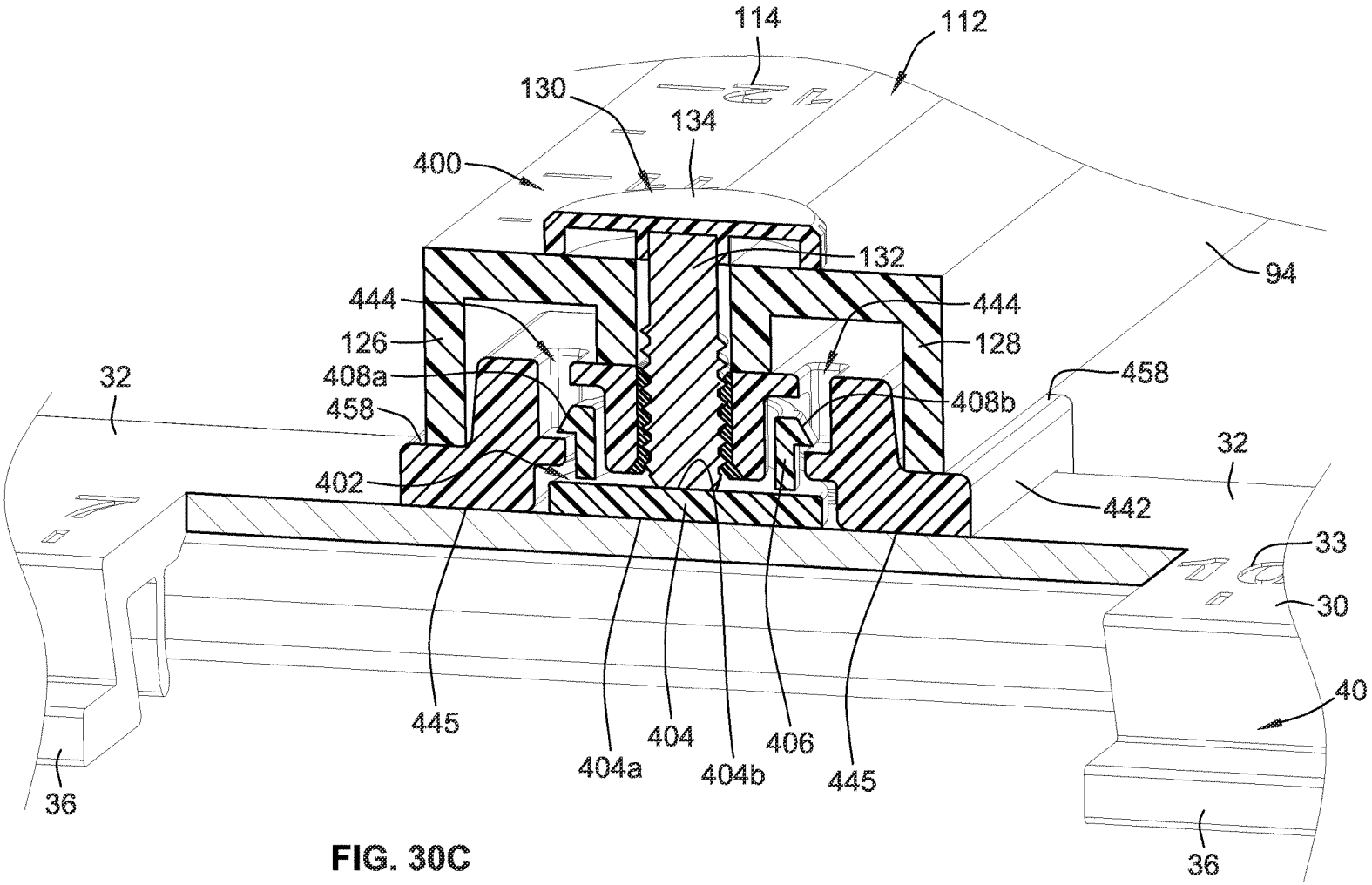

Alternatively to the method of locking an arm 94 to the crossbar 30 with the knob screw 130 described above (e.g., the distal end of the threaded shank 132 engaging the forward surface 32 of the crossbar 30, etc.), the arm 94 can be locked to the crossbar 30 using a fastener assembly 400 with a modified knuckle 442 as shown in FIGS. 30A-30C where like reference numbers are used for like components described herein.

The fastener assembly 400 includes the knob screw 130 and a cap 402. The cap 402 includes a lid 404, a cylindrical body 406, and a pair of protrusions 408*a,b*. The lid 404 is generally round with a forward surface 404*a* and a rearward surface 404*b*. The forward surface 404*a* of the lid 404 can be rounded (e.g., not flat). The cylindrical body 406 of the cap 402 extends from the rearward surface 404*b* of the lid 404. The protrusions 408*a,b* extend from opposing sides of the cylindrical body 406.

The cap 402 snaps into an annular cavity 444 in the rearward surface 445 of the modified knuckle 442 such that the protrusions 408*a,b* of the cap 402 lock and/or hold the cap 402 in the cavity 444. While the cap 402 is snapped into the cavity 444, in some implementations, the cap 402 has some vertical play in that the cap 402 can be moved vertically (e.g., up or down) with respect to the forward surface 32 of the crossbar 30. As shown in FIG. 30A, when the fastener assembly 400 is in a loosened position (e.g., not fully tightened as in FIG. 30C), a gap 446 exists between the forward surface 404*a* of the lid 404 of the cap 402 and the forward surface 32 of the crossbar 30. Additionally, when the fastener assembly 400 is in the loosened position (e.g., not fully tightened as in FIG. 30C), gaps 448*a,b* exists between a forward surface 558 of the modified knuckle 442 and the distal ends of protrusions 126, 128 of the arm 94.

Referring to FIG. 30B, as the knob screw 130 of the fastener assembly 400 is tightened, the distal end of threaded shank 132 initially engages (e.g., touches) the rearward surface 404*b* of the lid 404. As the knob screw 130 is further tightened, the distal end of threaded shank 132 forces the lid 404 downward such that the forward surface 404*a* of the lid 404 engages (e.g., touches) the forward surface 32 of the crossbar 30, thereby eliminating (e.g., or reducing) the gap 446 shown in FIG. 30A and locking the modified knuckle 442 in its relative position along the crossbar 30. With the modified knuckle 442 locked, the arm 94 is no longer permitted to move horizontally along the crossbar 30; however, the arm 94 is still permitted to move longitudinally (e.g., in a direction perpendicular to the edges 35, 36 of the crossbar 30) with respect to the modified knuckle 442 and the crossbar 30. While the further tightening of the knob screw 130 causes the cap 402 to move vertically downward, the protrusions 408*a,b* still maintain the cap 402 as being snapped into the cavity 444 of the modified knuckle 442.

Referring to FIG. 30C, as the knob screw 130 of the fastener assembly 400 is fully tightened, the distal end of threaded shank 132 further forces the lid 404 downward such that the head 134 of the knob screw 130 engages (e.g., touches) the forward surface 100 of the arm 94 and forces the arm 94 downward, thereby eliminating (e.g., or reducing) the gaps 448*a,b* shown in FIG. 30A and locking the arm 94 from moving longitudinally with respect to the modified knuckle 442 and the crossbar 30.

In some implementations, the fastener assembly 400 allows for the arms 94 of the device 28 to be locked in a dual stage fashion by tightening the knob screw 130 in two stages. For example, the fastener assembly 400 allows for the arms 94 to be first locked from moving horizontally and then to be locked from moving vertically by first tightening the knob screw of the fastener assembly 400 to a first position and then to a second position, where the knob screw in the second position is further tightened than in the first position. By further tightened, it is meant that the knob screw 130 is turned such that the threaded shank 132 moves vertically downward, thereby further threading the threaded shank 132 into the threaded hole 90.

In some implementations, the fastener assembly 400 further includes a washer (not shown). The washer can be positioned along the threaded shank 132 of the knob screw 130. For example, the washer can be positioned along the threaded shank 132 of the knob screw 130 between the head 134 and the forward surface 100 of the arm 94. Alternatively, the washer can be positioned along the threaded shank 132 of the knob screw 130 between the arm 94 and the modified knuckle 442.

Alternatively to the fastener assembly 400, various other methods of locking the arms 94 to the crossbar 30 in a dual stage fashion are contemplated. For example, a lever mechanism (not shown) can be used where a lever (e.g., instead of the head 134) is rotated to lock the arm 94. In some such alternative implementations, the lever is rotated less than three hundred and sixty degrees to fully lock the arm 94 to the crossbar 30. In other alternatives, the lever is rotated less than one hundred and eighty degrees to fully lock the arm 94 to the crossbar 30. Yet in further alternatives, the lever is rotated less than ninety degrees to fully lock the arm 94 to the crossbar 30.

As described herein and as best shown by comparing FIGS. 11 and 12, the marking pins 116 protrude from the forward surface 100 of the arms 94 a first distance and the top surface of the head 134 of the knob screw 130 protrudes a second distance from the forward surface 100 of the arms when the device 28 is in the assembled and fully tightened position (e.g., the knob screw 130 is fully screwed into the threaded hole 90). The marking pins 116 can be sized and shaped (e.g., designed) such that the first and the second distances are equal or different. In some implementations, a ratio of the first distance (i.e., distance the marking pin 116 protrudes from forward surface 100) to the second distance (i.e., distance the knob screw 130 protrudes from forward surface 100) can be, for example, 1.0, 0.9, 0.8, 0.6, 0.5, 0.3, etc. (e.g., if the first distance is 0.25 inches and the second distance is 0.4 inches, the ratio is 0.625).

As described above in reference to the knuckle 42, the upper flange 62 has the ramped surface 66 and the lower flange 64 has the ramped surface 68 such that the flanges 62, 64 and surfaces 66, 68 of the knuckle 42 are received in and/or about the track formed by the grooves 39, 40 such that the knuckle 42 is longitudinally slideable along the track of crossbar 30. In order to reduce play of the knuckle 42 when sliding along the track of the crossbar 30, it is desirable for the ramped surfaces 66, 68 to be substantially flat. However, in some implementations, the knuckles 42 are formed using an injection molding process that requires one or both of the ramped surfaces 66, 68 to not be substantially flat (e.g., including a drafting angle from the center of the ramped surfaces 66, 68 out towards the ends). In such implementations, the drafting angle of the ramped surfaces 66, 68 can be, for example, between 0.1 degrees and three degrees. In some implementations, the drafting angle of only one of the ramped surfaces 66, 68 is, for example, between 0.1 degrees and three degrees and the drafting angle of the other one of the ramped surfaces 66, 68 is zero degrees.

While the present disclosure has been described with respect to several illustrative examples, it will be appreciated that many modifications and variations can be made without departing from the spirit and scope of the disclosure. It is therefore the intent of the appended claims to cover all such modifications and variations that fall within the spirit and scope of the present disclosure.

What is claimed is:

1. A device for hanging an object on a wall, comprising:
- a crossbar including a track extending between two opposing ends of the crossbar;
- a knuckle slidably coupled to the crossbar;
- a marking pin projecting in a direction generally perpendicular from a forward surface of the knuckle; and
- an end member coupled to the crossbar, the end member including an engagement surface.

2. The device of claim 1, wherein the end member includes an "L" bracket, the "L" bracket providing the engagement surface for engaging a corner of an object previously hung on the wall.

3. The device of claim 1, further comprising a fastener assembly configured to both removably couple an arm to the knuckle and slidably couple the arm to the knuckle;
- wherein the knuckle is configured to slide relative to the crossbar in a first direction; and
- wherein the arm is configured to slide relative to the knuckle in a second direction different from the first direction.

4. The device of claim 1, further comprising an arm, the arm slidably coupled to the knuckle.

5. The device of claim 4, wherein the arm is rotatably coupled to the knuckle.

6. The device of claim 5, further comprising a fastener assembly configured to lock the arm in any of a plurality of positions relative to the crossbar.

7. The device of claim 4, further comprising
- a first plurality of dimensional markings disposed on a forward surface of the crossbar, the first plurality of dimensional markings designating a longitudinal center of the crossbar, the longitudinal center of the crossbar intersecting a centroid of the crossbar; and
- a second plurality of dimensional markings disposed on a forward surface of the arm.

* * * * *